US011788781B2

(12) United States Patent
Taguchi et al.

(10) Patent No.: US 11,788,781 B2
(45) Date of Patent: Oct. 17, 2023

(54) REFRIGERATION DEVICE AND METHOD FOR DETERMINING AMOUNT OF REFRIGERANT IN REFRIGERATION DEVICE

(71) Applicant: DAIKIN INDUSTRIES, LTD., Osaka (JP)

(72) Inventors: Shuichi Taguchi, Osaka (JP); Masaaki Takegami, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/137,006

(22) Filed: Apr. 20, 2023

(65) Prior Publication Data

US 2023/0272954 A1 Aug. 31, 2023

Related U.S. Application Data

(63) Continuation of application No. PCT/JP2021/037999, filed on Oct. 14, 2021.

(30) Foreign Application Priority Data

Nov. 24, 2020 (JP) ..... 2020-194568

(51) Int. Cl.
*F25B 9/00* (2006.01)
*F25B 49/02* (2006.01)

(52) U.S. Cl.
CPC ..... *F25B 49/022* (2013.01); *F25B 9/008* (2013.01); *F25B 2309/061* (2013.01);
(Continued)

(58) Field of Classification Search
CPC ..... F25B 2400/16; F25B 2400/23; F25B 2600/05; F25B 2600/2523; F25B 2700/04
See application file for complete search history.

(56) References Cited

U.S. PATENT DOCUMENTS 7,891,201 B1 * 2/2011 Bush ..... F25B 1/10 62/115

FOREIGN PATENT DOCUMENTS

JP 2012-117713 A 6/2012
JP 2014-102008 A 6/2014
JP 2014102008 A * 6/2014 ..... F25B 49/02

OTHER PUBLICATIONS

International Search Report, issued in PCT/JP2021/037999, PCT/ISA/210, dated Nov. 9, 2021.
(Continued)

*Primary Examiner* — Henry T Crenshaw
*Assistant Examiner* — Daniel C Comings
(74) *Attorney, Agent, or Firm* — Birch, Stewart, Kolasch & Birch, LLP

(57) ABSTRACT

A refrigeration apparatus (1) includes a heat-source-side unit (10) using a refrigerant that works in a supercritical region. The heat-source-side unit (10) includes a compression element (20) configured to compress the refrigerant, a heat-source-side heat exchanger (24), an expansion valve (26) provided downstream of the heat-source-side heat exchanger (24), a receiver (25) provided downstream of the expansion valve (26), and a control unit (101). The control unit (101) performs a first operation for evaluating the amount of the refrigerant based on a high-pressure-side pressure, on a first condition that the internal pressure of the receiver (25) be equal to or less than a supercritical pressure.

18 Claims, 13 Drawing Sheets

(52) U.S. Cl.
CPC ..... *F25B 2313/0233* (2013.01); *F25B 2313/0313* (2013.01); *F25B 2500/23* (2013.01); *F25B 2500/24* (2013.01); *F25B 2600/0251* (2013.01); *F25B 2600/05* (2013.01); *F25B 2600/2523* (2013.01); *F25B 2700/04* (2013.01); *F25B 2700/195* (2013.01)

(56) References Cited

OTHER PUBLICATIONS

Written Opinion of the International Searching Authority, issued in PCT/JP2021/037999, PCT/ISA/237, dated Nov. 9, 2021.
International Preliminary Report on Patentability with English translation of the Written Opinion of the International Searching Authority for International Application No. PCT/JP2021/037999, dated Jun. 8, 2023.

* cited by examiner

REFRIGERATION-FACILITY OPERATION

COOLING OPERATION

COOLING AND REFRIGERATION-FACILITY OPERATION

HEATING OPERATION

HEATING AND REFRIGERATION-FACILITY OPERATION

REFRIGERATION DEVICE AND METHOD FOR DETERMINING AMOUNT OF REFRIGERANT IN REFRIGERATION DEVICE

TECHNICAL FIELD

The present disclosure relates to a refrigeration apparatus and a method for determining the amount of a refrigerant in the refrigeration apparatus.

BACKGROUND ART

A refrigeration apparatus that performs a refrigeration cycle has been known in the art. A refrigeration apparatus of Patent Document 1 performs a refrigeration cycle in which the high-pressure-side pressure is equal to or greater than a critical pressure. In this refrigeration apparatus, the amount of a refrigerant in a refrigerant circuit is determined based on the high-pressure-side pressure of a refrigerant circuit for refrigeration so that the amount of the refrigerant in the refrigerant circuit can be appropriately managed.

CITATION LIST

Patent Document

Patent Document 1: Japanese Unexamined Patent Publication No. 2012-117713

SUMMARY

A first aspect is directed to a refrigeration apparatus (1) including: a heat-source-side unit (10) using a refrigerant that works in a supercritical region. The heat-source-side unit (10) includes a compression element (20) configured to compress the refrigerant, a heat-source-side heat exchanger (24), an expansion valve (26) provided downstream of the heat-source-side heat exchanger (24), a receiver (25) provided downstream of the expansion valve (26), and a control unit (101). The control unit (101) performs a first operation for evaluating an amount of the refrigerant based on a high-pressure-side pressure, on a first condition that an internal pressure of the receiver (25) be equal to or less than a supercritical pressure.

DESCRIPTION OF EMBODIMENTS

Embodiments will be described below with reference to the drawings. The embodiments below are merely exemplary ones in nature, and are not intended to limit the scope, applications, or use of the invention.

«Embodiment»

General Configuration

A refrigeration apparatus (1) according to an embodiment performs cooling of an object to be cooled and air-conditioning of an indoor space in parallel. The object to be cooled herein includes air in facilities such as a refrigerator, a freezer, and a show case. Hereinafter, such facilities are each referred to as a refrigeration facility.

Figure 1:
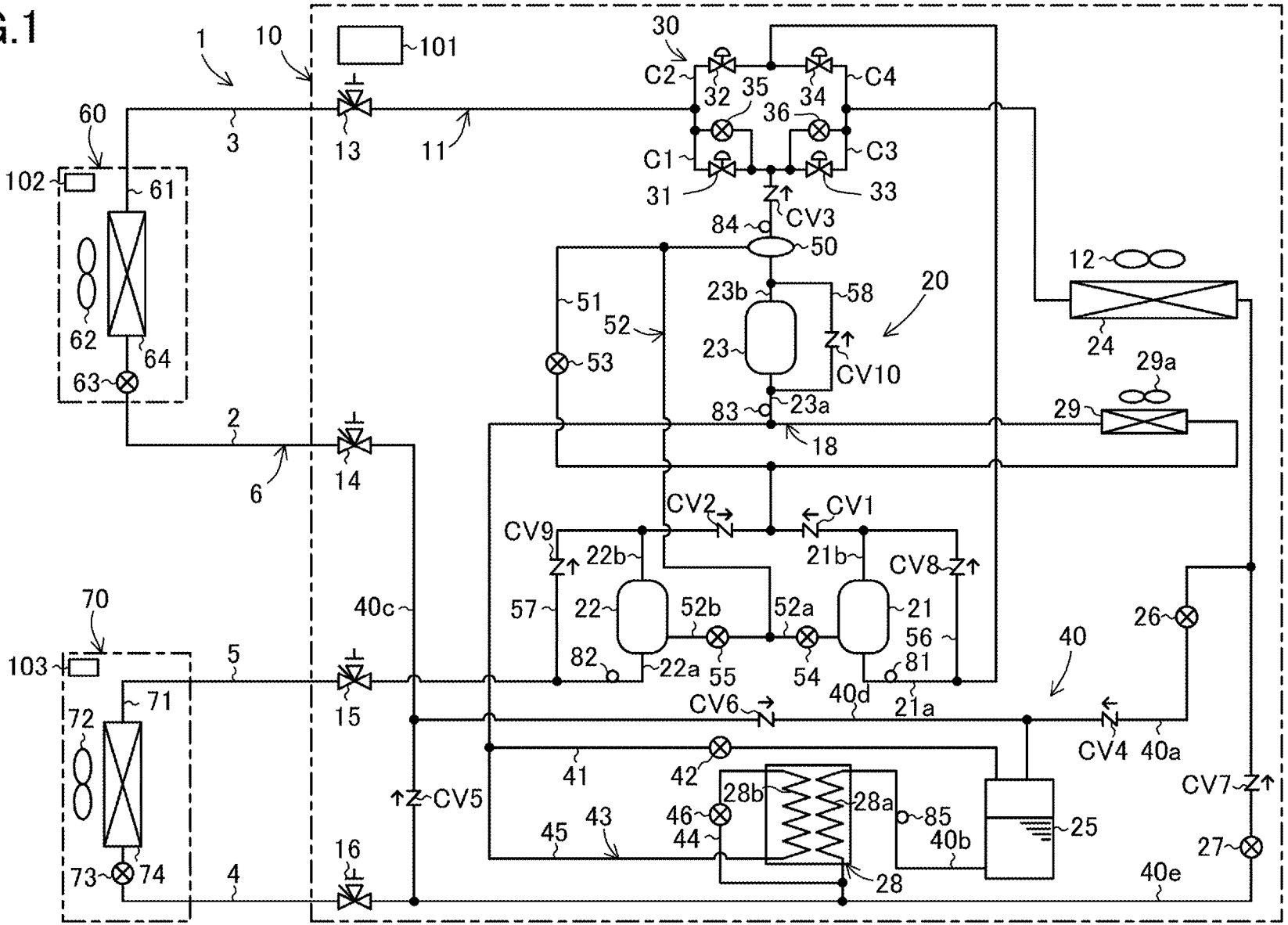
FIG. 1 is a piping system diagram of a refrigeration apparatus according to an embodiment.
Figure 2:
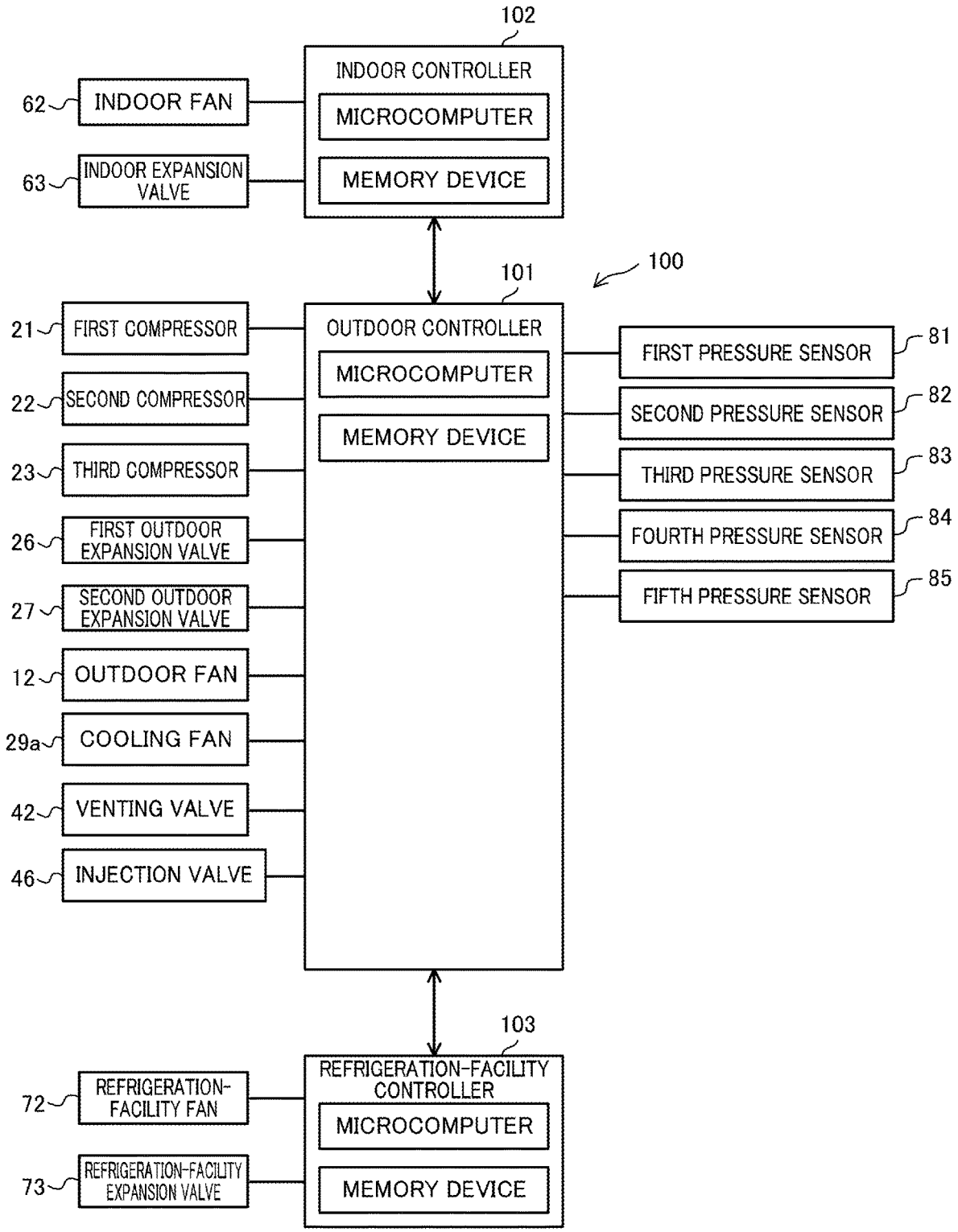
FIG. 2 is a block diagram illustrating a relationship among controllers, various sensors, and various components in the refrigeration apparatus according to the embodiment.

As illustrated in FIG. 1, the refrigeration apparatus (1) includes a heat-source-side unit (10) placed outside, an air-conditioning unit (60) configured to perform air-conditioning of an indoor space, and a refrigeration-facility unit (70) configured to cool inside air. As illustrated in FIG. 2, the refrigeration apparatus (1) includes a controller (100) configured to control a refrigerant circuit (6). FIG. 1 shows a single air-conditioning unit (60). The refrigeration apparatus (1) may include two or more air-conditioning units (60) connected to each other in parallel. FIG. 1 shows a single refrigeration-facility unit (70). The refrigeration apparatus (1) may include two or more refrigeration-facility units (70) connected to each other in parallel. These units (10, 60, 70) are connected to each other via four connection pipes (2, 3, 4, 5) to constitute a refrigerant circuit (6).

The four connection pipes (2, 3, 4, 5) consist of a first liquid connection pipe (2), a first gas connection pipe (3), a second liquid connection pipe (4), and a second gas connection pipe (5). The first liquid connection pipe (2) and the first gas connection pipe (3) are associated with the air-conditioning unit (60). The second liquid connection pipe (4) and the second gas connection pipe (5) are associated with the refrigeration-facility unit (70).

The refrigerant circuit (6) is filled with a refrigerant. The refrigerant circuit (6) circulates the refrigerant to perform a refrigeration cycle. A refrigerant that works in a supercritical region, such as carbon dioxide, is used as the refrigerant of this embodiment. The refrigerant circuit (6) performs the refrigeration cycle so that the refrigerant has a pressure equal to or greater than a critical pressure.

<Outline of Heat-Source-Side Unit>

The heat-source-side unit (10) includes a heat-source-side circuit (11) and an outdoor fan (12). The heat-source-side circuit (11) includes a compression element (20), a heat-source-side heat exchanger (outdoor heat exchanger) (24), and a refrigerant container (receiver) (25). The heat-source-side circuit (11) includes a first outdoor expansion valve (26) and a second outdoor expansion valve (27). The heat-source-side circuit (11) further includes a cooling heat exchanger (28) and an intercooler (29).

The heat-source-side circuit (11) includes four shut-off valves (13, 14, 15, 16). The four shut-off valves consist of a first gas shut-off valve (13), a first liquid shut-off valve (14), a second gas shut-off valve (15), and a second liquid shut-off valve (16).

The first gas connection pipe (3) is connected to the first gas shut-off valve (13). The first liquid connection pipe (2) is connected to the first liquid shut-off valve (14). The second gas connection pipe (5) is connected to the second gas shut-off valve (15). The second liquid connection pipe (4) is connected to the second liquid shut-off valve (16).

<Compression Element>

The compression element (20) compresses the refrigerant. The compression element (20) includes a first compressor (21), a second compressor (22), and a third compressor (23). The compression element (20) performs an operation in which the refrigerant is compressed in a single stage and an operation in which the refrigerant is compressed in two stages.

The first compressor (21) is an air-conditioning compressor associated with the air-conditioning unit (60). The second compressor (22) is a refrigeration-facility compressor associated with the refrigeration-facility unit (70). The first and second compressors (21) and (22) are low-stage compressors. The first and second compressors (21) and (22) are connected in parallel. In the present disclosure, the first and second compressors (21) and (22) may also be referred to also as the "low-stage compressors (21, 22)."

The third compressor (23) is a high-stage compressor. The third compressor (23) is connected in series to the first compressor (21). The third compressor (23) is connected in series to the second compressor (22). In the present disclosure, the third compressor (23) may be referred to also as the "high-stage compressor (23)."

The first, second, and third compressors (21), (22), and (23) are each a rotary compressor in which a motor drives a compression mechanism. The first, second, and third compressors (21), (22), and (23) are each a variable displacement compressor. The number of revolutions of each of the first, second, and third compressors (21), (22), and (23) is adjusted by an inverter device.

A first suction pipe (21*a*) and a first discharge pipe (21*b*) are connected to the first compressor (21). A second suction pipe (22*a*) and a second discharge pipe (22*b*) are connected to the second compressor (22). A third suction pipe (23*a*) and a third discharge pipe (23*b*) are connected to the third compressor (23).

<Intermediate Flow Path>

The heat-source-side circuit (11) includes an intermediate flow path (18). The intermediate flow path (18) connects discharging portions of the first and second compressors (21) and (22) and a suction portion of the third compressor (23) together. The intermediate flow path (18) includes the first discharge pipe (21*b*), the second discharge pipe (22*b*), and the third suction pipe (23*a*).

<Flow Path Switching Mechanism>

A flow path switching mechanism (30) switches the flow path for the refrigerant. The flow path switching mechanism (30) includes a first flow path (C1), a second flow path (C2), a third flow path (C3), and a fourth flow path (C4). The first, second, third, and fourth flow paths (C1), (C2), (C3), and (C4) are connected in a bridge configuration.

One end of the first flow path (C1) and one end of the third flow path (C3) are connected to a discharging portion of the third compressor (23) via the third discharge pipe (23*b*). One end of the second flow path (C2) and one end of the fourth flow path (C4) are connected to a suction portion of the first compressor (21) via the first suction pipe (21*a*). The other end of the first flow path (C1) and the other end of the second flow path (C2) are connected to the air-conditioning unit (60) via the first gas connection pipe (3). The other end of the third flow path (C3) and the other end of the fourth flow path (C4) are connected to a gas end of the outdoor heat exchanger (24).

The flow path switching mechanism (30) includes a first on-off valve (31), a second on-off valve (32), a third on-off valve (33), and a fourth on-off valve (34). The first on-off valve (31) opens and closes the first flow path (C1). The second on-off valve (32) opens and closes the second flow path (C2). The third on-off valve (33) opens and closes the third flow path (C3). The fourth on-off valve (34) opens and closes the fourth flow path (C4). Each of the on-off valves (31, 32, 33, 34) is configured as an electromagnetic on-off valve. Each of the on-off valves (31, 32, 33, 34) may be an electronic expansion valve that has its opening degree adjusted based on a pulse signal. Alternatively, to open and close the first flow path (C1), a fifth on-off valve (35) configured as an electronic expansion valve may be provided in parallel with the first on-off valve (31) configured as an electromagnetic on-off valve. In addition, to open and close the third flow path (C3), a sixth on-off valve (36) configured as an electronic expansion valve may be provided in parallel with the third on-off valve (33) configured as an electromagnetic on-off valve.

<Outdoor Heat Exchanger and Outdoor Fan>

The outdoor heat exchanger (24) is a fin-and-tube air heat exchanger. The outdoor fan (12) is arranged near the outdoor heat exchanger (24). The outdoor fan (12) transfers outdoor air. The outdoor heat exchanger (24) exchanges heat between the refrigerant flowing therethrough and the outdoor air transferred from the outdoor fan (12). In the present disclosure, the outdoor heat exchanger (24) may be referred to also as the heat-source-side heat exchanger (24).

<Liquid Side Flow Path>

The heat-source-side circuit (11) includes a liquid side flow path (40). The liquid side flow path (40) is provided between a liquid end of the outdoor heat exchanger (24) and a pair of the two liquid shut-off valves (14, 16). The liquid side flow path (40) includes first to fifth pipes (40*a*, 40*b*, 40*c*, 40*d*, 40*e*).

One end of the first pipe (40*a*) is connected to the liquid end of the outdoor heat exchanger (24). The other end of the first pipe (40*a*) is connected to the top of the receiver (25). One end of the second pipe (40*b*) is connected to the bottom of the receiver (25). The other end of the second pipe (40*b*) is connected to the second liquid shut-off valve (16). One end of the third pipe (40*c*) is connected to an intermediate portion of the second pipe (40*b*). The other end of the third pipe (40*c*) is connected to the first liquid shut-off valve (14). One end of the fourth pipe (40*d*) is connected to the first pipe (40*a*) between the first outdoor expansion valve (26) and the receiver (25). The other end of the fourth pipe (40*d*) is connected to an intermediate portion of the third pipe (40*c*). One end of the fifth pipe (40*e*) is connected to the first pipe (40*a*) between the outdoor heat exchanger (24) and the first outdoor expansion valve (26). The other end of the fifth pipe (40*e*) is connected to the second pipe (40*b*) between the receiver (25) and the junction between the second pipe (40*b*) and the third pipe (40*c*).

<Outdoor Expansion Valve>

The first outdoor expansion valve (26) is provided in the first pipe (40*a*). The first outdoor expansion valve (26) is provided in the first pipe (40*a*) between the liquid end of the outdoor heat exchanger (24) and the junction between the first pipe (40*a*) and the fourth pipe (40*d*). The second outdoor expansion valve (27) is provided in the fifth pipe (40*e*). The first and second outdoor expansion valves (26) and (27) are each an expansion valve having a variable opening degree. The first and second outdoor expansion valves (26) and (27) may be each an electronic expansion valve that has its opening degree adjusted based on a pulse signal.

<Receiver>

The receiver (25) is an airtight refrigerant container that stores the refrigerant. The receiver (25) separates the refrigerant into a gas refrigerant and a liquid refrigerant. A gas layer and a liquid layer are formed inside the receiver (25). The gas layer is formed near the top of the receiver (25). The liquid layer is formed near the bottom of the receiver (25).

<Venting Pipe>

The heat-source-side circuit (11) has a venting pipe (41). One end of the venting pipe (41) is connected to the top of the receiver (25). The other end of the venting pipe (41) is connected to the intermediate flow path (18). The venting pipe (41) introduces the gas refrigerant in the receiver (25) into the intermediate flow path (18), i.e., the suction pipe (23*a*) of the high-stage compressor (third compressor) (23). In other words, the venting pipe (41) is a joint pipe that connects the pipe (first pipe) (40*a*) downstream of the first outdoor expansion valve (26) and the third suction pipe (23*a*) together via the receiver (25). In the present disclosure, the venting pipe (41) may be referred to also as the "joint pipe (41)."

The venting pipe (41) is provided with a venting valve (42). The venting valve (42) is an expansion valve having a variable opening degree. The venting valve (42) may be an electronic expansion valve that has its opening degree adjusted based on a pulse signal.

<Cooling Heat Exchanger>

The cooling heat exchanger (28) has a high-pressure flow path (28*a*) and a low-pressure flow path (28*b*). The cooling heat exchanger (28) exchanges heat between the refrigerant in the high-pressure flow path (28*a*) and the refrigerant in the low-pressure flow path (28*b*). In other words, the cooling heat exchanger (28) cools the refrigerant flowing through the high-pressure flow path (28*a*) using the refrigerant flowing through the low-pressure flow path (28*b*).

The low-pressure flow path (28*b*) forms part of an injection flow path (43). The injection flow path (43) includes an upstream flow path (44) and a downstream flow path (45).

One end of the upstream flow path (44) is connected to a portion of the second pipe (40*b*) upstream of the junction between the second pipe (40*b*) and the fifth pipe (40*e*). The other end of the upstream flow path (44) is connected to an inflow end of the low-pressure flow path (28*b*). The upstream flow path (44) is provided with an injection valve (46). The injection valve (46) is an expansion valve having a variable opening degree. The injection valve (46) may be an electronic expansion valve that has its opening degree adjusted based on a pulse signal.

One end of the downstream flow path (45) is connected to an outflow end of the low-pressure flow path (28*b*). The other end of the downstream flow path (45) is connected to the venting pipe (joint pipe) (41).

<Intercooler>

The intercooler (29) is provided in the intermediate flow path (18). The intercooler (29) is a fin-and-tube air heat exchanger. A cooling fan (29*a*) is arranged near the intercooler (29). The intercooler (29) exchanges heat between the refrigerant flowing therethrough and the outdoor air transferred from the cooling fan (29*a*).

<Oil Separation Circuit>

The heat-source-side circuit (11) includes an oil separation circuit. The oil separation circuit includes an oil separator (50), a first oil return pipe (51), and a second oil return pipe (52).

The oil separator (50) is connected to the third discharge pipe (23*b*). The oil separator (50) separates oil from the refrigerant discharged from the compression element (20). Inflow ends of the first and second oil return pipes (51) and (52) communicate with the oil separator (50). An outflow end of the first oil return pipe (51) is connected to the intermediate flow path (18). The first oil return pipe (51) is provided with a first oil level control valve (53).

An outflow portion of the second oil return pipe (52) branches into a first branch pipe (52*a*) and a second branch pipe (52*b*). The first branch pipe (52*a*) is connected to an oil reservoir of the first compressor (21). The second branch pipe (52*b*) is connected to an oil reservoir of the second compressor (22). The first branch pipe (52*a*) is provided with a second oil level control valve (54). The second branch pipe (52*b*) is provided with a third oil level control valve (55).

<Bypass Pipe>

The heat-source-side circuit (11) includes a first bypass pipe (56), a second bypass pipe (57), and a third bypass pipe (58). The first bypass pipe (56) is associated with the first compressor (21). The second bypass pipe (57) is associated with the second compressor (22). The third bypass pipe (58) is associated with the third compressor (23).

Specifically, the first bypass pipe (56) directly connects the first suction pipe (21*a*) and the first discharge pipe (21*b*) together. The second bypass pipe (57) directly connects the second suction pipe (22*a*) and the second discharge pipe (22*b*) together. The third bypass pipe (58) directly connects the third suction pipe (23*a*) and the third discharge pipe (23*b*) together.

<Check Valve>

The heat-source-side circuit (11) includes a plurality of check valves. The plurality of check valves include first to tenth check valves (CV1 to CV10). The check valves (CV1 to CV10) allow the refrigerant to flow in the directions indicated by the respective arrows of FIG. 1, and disallow the refrigerant to flow in the directions opposite thereto.

The first check valve (CV1) is provided in the first discharge pipe (21*b*). The second check valve (CV2) is provided in the second discharge pipe (22*b*). The third check valve (CV3) is provided in the third discharge pipe (23*b*). The fourth check valve (CV4) is provided in the first pipe (40*a*). The fifth check valve (CV5) is provided in the third pipe (40*c*). The sixth check valve (CV6) is provided in the fourth pipe (40*d*). The seventh check valve (CV7) is provided in the fifth pipe (40*e*). The eighth check valve (CV8) is provided in the first bypass pipe (56). The ninth check valve (CV9) is provided in the second bypass pipe (57). The tenth check valve (CV10) is provided in the third bypass pipe (58).

<Air-Conditioning Unit>

The air-conditioning unit (60) is a first utilization-side unit installed indoors. The evaporation temperature of the refrigerant in the air-conditioning unit (60) is higher than that of the refrigerant in the refrigeration-facility unit (70). The air-conditioning unit (60) includes an indoor circuit (61) and an indoor fan (62). A liquid end of the indoor circuit (61) is connected to the first liquid connection pipe (2). A gas end of the indoor circuit (61) is connected to the first gas connection pipe (3).

The indoor circuit (61) includes an indoor expansion valve (63) and an indoor heat exchanger (64) in order from the liquid end to the gas end. In other words, the indoor expansion valve (63) is provided at the inlet of the indoor heat exchanger (64). The indoor expansion valve (63) is an expansion valve having a variable opening degree. The indoor expansion valve (63) may be an electronic expansion valve that has its opening degree adjusted based on a pulse signal.

The indoor heat exchanger (64) is a fin-and-tube air heat exchanger. The indoor fan (62) is arranged near the indoor heat exchanger (64). The indoor fan (62) transfers indoor air. The indoor heat exchanger (64) exchanges heat between the refrigerant flowing therethrough and the indoor air transferred by the indoor fan (62).

<Refrigeration-Facility Unit>

The refrigeration-facility unit (70) is a second utilization-side unit that cools its internal space. The refrigeration-facility unit (70) includes a refrigeration-facility circuit (71) and a refrigeration-facility fan (72). A liquid end of the refrigeration-facility circuit (71) is connected to the second liquid connection pipe (4). A gas end of the refrigeration-facility circuit (71) is connected to the second gas connection pipe (5).

The refrigeration-facility circuit (71) includes a refrigeration-facility expansion valve (73) and a refrigeration-facility heat exchanger (74) in order from the liquid end to the gas end. In other words, the refrigeration-facility expansion valve (73) is provided at the inlet of the refrigeration-facility heat exchanger (74). The refrigeration-facility expansion valve (73) is an expansion valve having a variable opening degree. The refrigeration-facility expansion valve (73) may be an electronic expansion valve that has its opening degree adjusted based on a pulse signal.

The refrigeration-facility heat exchanger (74) is a fin-and-tube air heat exchanger. The refrigeration-facility fan (72) is arranged near the refrigeration-facility heat exchanger (74). The refrigeration-facility fan (72) transfers inside air. The refrigeration-facility heat exchanger (74) exchanges heat between the refrigerant flowing therethrough and the inside air transferred by the refrigeration-facility fan (72).

In the present disclosure, the air-conditioning unit (60) and the refrigeration-facility unit (70) may be referred to also as the utilization-side units (60, 70). The indoor expansion valve (63) and the refrigeration-facility expansion valve (73) may be referred to as the utilization-side expansion valves (63, 73), and the indoor heat exchanger (64) and the refrigeration-facility heat exchanger (74) may be referred to as the utilization-side heat exchangers (64, 74).

<Sensor>

The refrigeration apparatus (1) has a plurality of sensors. The plurality of sensors include a first pressure sensor (81), a second pressure sensor (82), a third pressure sensor (83), a fourth pressure sensor (84), and a fifth pressure sensor (85).

The first pressure sensor (81) detects the pressure of the refrigerant to be sucked into the first compressor (21). The second pressure sensor (82) detects the pressure of the refrigerant to be sucked into the second compressor (22). The third pressure sensor (83) detects the pressure of the refrigerant in the intermediate flow path (18) (hereinafter referred to also as the intermediate pressure (MP)), i.e., the pressure of the refrigerant to be sucked into the third compressor (23). The fourth pressure sensor (84) detects the pressure of the refrigerant discharged from the third compressor (23) (hereinafter referred to also as the high-pressure-side pressure (HP)). The fifth pressure sensor (85) detects the pressure of the refrigerant that has flowed out of the receiver (25). The pressure detected by the fifth pressure sensor (85) determines the internal pressure (RP) of the receiver (25).

Although not shown, the refrigeration apparatus (1) includes sensors other than the pressure sensors, such as a temperature sensor configured to detect the outdoor air temperature, and temperature sensors each configured to detect the refrigerant temperatures at respective locations in the refrigerant circuit (6).

<Controller>

The controller (100) includes a microcomputer mounted on a control board and a memory device (specifically, a semiconductor memory) that stores software for operating the microcomputer. The controller (100) controls various components of the refrigeration apparatus (1) based on detection signals of various sensors.

As illustrated in FIG. 2, the controller (100) includes an outdoor controller (101), an indoor controller (102), and a refrigeration-facility controller (103). As illustrated in FIG. 1, the outdoor controller (101) is provided for the heat-source-side unit (10). The indoor controller (102) is provided for the air-conditioning unit (60). The refrigeration-facility controller (103) is provided for the refrigeration-facility unit (70). The outdoor controller (101) is able to communicate with the indoor controller (102) and the refrigeration-facility controller (103).

As will be described later, in this embodiment, the outdoor controller (101) provided for the heat-source-side unit (10) evaluates the amount of the refrigerant in the refrigeration apparatus (1). In the present disclosure, the outdoor controller (101) may be simply referred to also as the control unit (101).

—Operation—

The operation of the refrigeration apparatus (1) will be described below. Operations of the refrigeration apparatus (1) include a refrigeration-facility operation, a cooling operation, a cooling and refrigeration-facility operation, a heating operation, and a heating and refrigeration-facility operation.

In the refrigeration-facility operation, the refrigeration-facility unit (70) cools inside air, and the air-conditioning unit (60) is paused. In the cooling operation, the refrigeration-facility unit (70) is paused, and the air-conditioning unit (60) performs cooling of the indoor space. In the cooling and refrigeration-facility operation, the refrigeration-facility unit (70) cools inside air, and the air-conditioning unit (60) performs cooling of the indoor space. In the heating operation, the refrigeration-facility unit (70) is paused, and the air-conditioning unit (60) performs heating of the indoor space. In the heating and refrigeration-facility operation, the refrigeration-facility unit (70) cools inside air, and the air-conditioning unit (60) performs heating of the indoor space.

An outline of each of the operations will be described with reference to FIGS. 3 to 7. In the drawings, the directions of flows of the refrigerant are indicated by broken arrows, and the flow paths through each of which the refrigerant flows are thickened. In the drawings, the heat exchanger serving as a radiator is hatched, and the heat exchanger serving as an evaporator is dotted.

<Refrigeration-Facility Operation>

Figure 3:
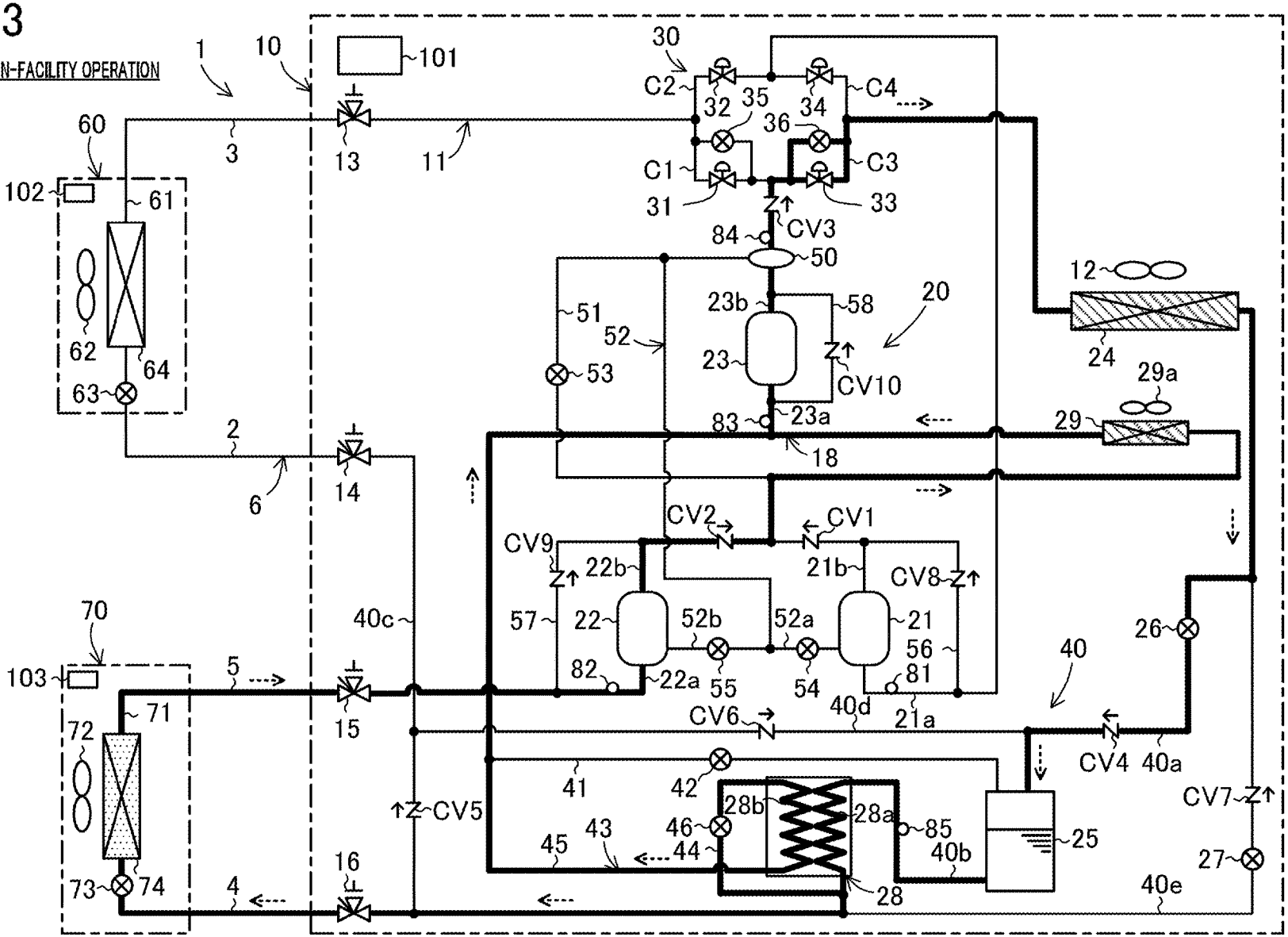
FIG. 3 illustrates a flow of a refrigerant during a refrigeration-facility operation in the refrigeration apparatus illustrated in FIG. 1.

In the refrigeration-facility operation illustrated in FIG. 3, the controller (100) closes the first, second, fourth, and fifth on-off valves (31), (32), (34), and (35), and opens the third and/or sixth on-off valve (33) and/or (36). The controller (100) pauses the first compressor (21), and operates the second and third compressors (22) and (23). The controller (100) opens the first outdoor expansion valve (26) and the injection valve (46) to a predetermined opening degree, and closes the second outdoor expansion valve (27). The controller (100) closes the indoor expansion valve (63), and adjusts the opening degree of the refrigeration-facility expansion valve (73). The controller (100) operates the outdoor fan (12) and the refrigeration-facility fan (72), and pauses the indoor fan (62).

In the refrigeration-facility operation, the refrigeration cycle is performed in which the outdoor heat exchanger (24) functions as a radiator, the function of the indoor heat exchanger (64) is substantially disabled, and the refrigeration-facility heat exchanger (74) functions as an evaporator.

Specifically, the refrigerant compressed by the second compressor (22) is cooled in the intercooler (29), and is then sucked into the third compressor (23). The refrigerant compressed to a pressure equal to or greater than the critical pressure by the third compressor (23) dissipates heat in the outdoor heat exchanger (24), and then passes through the first outdoor expansion valve (26). The first outdoor expansion valve (26) decompresses the refrigerant to a pressure less than the critical pressure.

The refrigerant in a subcritical state flows into the receiver (25). The receiver (25) separates the refrigerant into a gas refrigerant and a liquid refrigerant.

The liquid refrigerant separated in the receiver (25) is cooled in the cooling heat exchanger (28) by the refrigerant flowing through the injection flow path (43). The refrigerant in the injection flow path (43) is sent to the intermediate flow path (18).

The refrigerant cooled by the cooling heat exchanger (28) is sent to the refrigeration-facility unit (70). The refrigerant sent to the refrigeration-facility unit (70) is decompressed by the refrigeration-facility expansion valve (73), and then evaporates in the refrigeration-facility heat exchanger (74). As a result, the inside air is cooled. The refrigerant that has evaporated in the cooling heat exchanger (28) is sucked into the second compressor (22), and is then compressed again.

<Cooling Operation>

Figure 4:
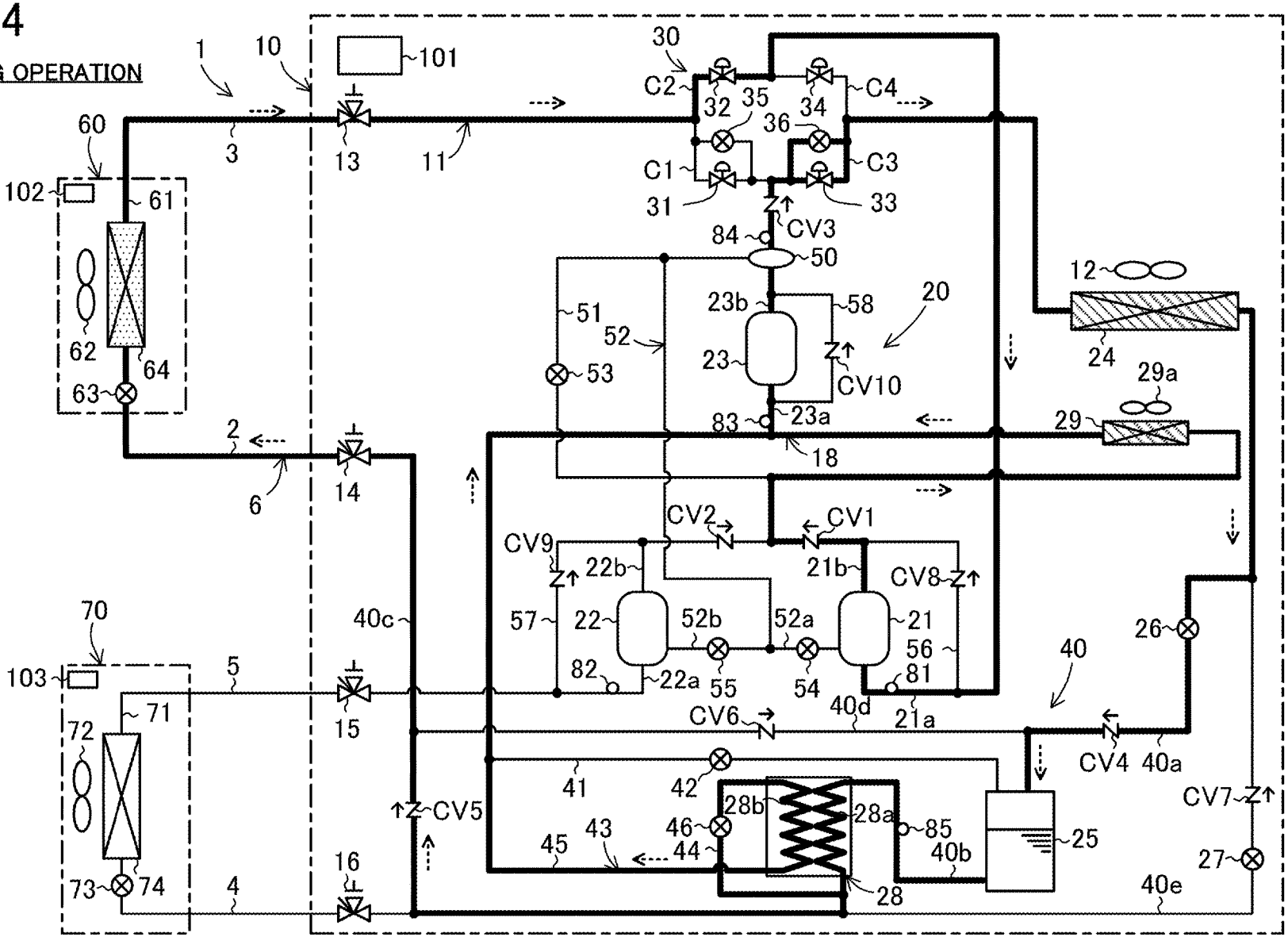
FIG. 4 illustrates a flow of a refrigerant during a cooling operation in the refrigeration apparatus illustrated in FIG. 1.

In the cooling operation illustrated in FIG. 4, the controller (100) closes the first, fourth, and fifth on-off valves (31), (34), and (35), and opens the second on-off valve (32) and the third and/or sixth on-off valve (33) and/or (36). The controller (100) pauses the second compressor (22), and operates the first and third compressors (21) and (23). The controller (100) opens the first outdoor expansion valve (26) and the injection valve (46) to a predetermined opening degree, and closes the second outdoor expansion valve (27). The controller (100) closes the refrigeration-facility expansion valve (73), and adjusts the opening degree of the indoor expansion valve (63). The controller (100) operates the outdoor fan (12) and the indoor fan (62), and pauses the refrigeration-facility fan (72).

In the cooling operation, the refrigeration cycle is performed in which the outdoor heat exchanger (24) functions as a radiator, the indoor heat exchanger (64) functions as an evaporator, and the function of the refrigeration-facility heat exchanger (74) is substantially disabled.

Specifically, the refrigerant compressed by the first compressor (21) is cooled in the intercooler (29), and is then sucked into the third compressor (23). The refrigerant compressed to a pressure equal to or greater than the critical pressure by the third compressor (23) dissipates heat in the outdoor heat exchanger (24), and then passes through the first outdoor expansion valve (26). The first outdoor expansion valve (26) decompresses the refrigerant to a pressure less than the critical pressure.

The refrigerant in a subcritical state flows into the receiver (25). The receiver (25) separates the refrigerant into a gas refrigerant and a liquid refrigerant.

The liquid refrigerant separated in the receiver (25) is cooled in the cooling heat exchanger (28) by the refrigerant flowing through the injection flow path (43). The refrigerant in the injection flow path (43) is sent to the intermediate flow path (18).

The refrigerant cooled by the cooling heat exchanger (28) is sent to the air-conditioning unit (60). The refrigerant sent to the air-conditioning unit (60) is decompressed by the indoor expansion valve (63), and then evaporates in the indoor heat exchanger (64). As a result, the indoor air is cooled. The refrigerant that has evaporated in the indoor heat exchanger (64) is sucked into the first compressor (21), and is then compressed again.

<Cooling and Refrigeration-Facility Operation>

Figure 5:
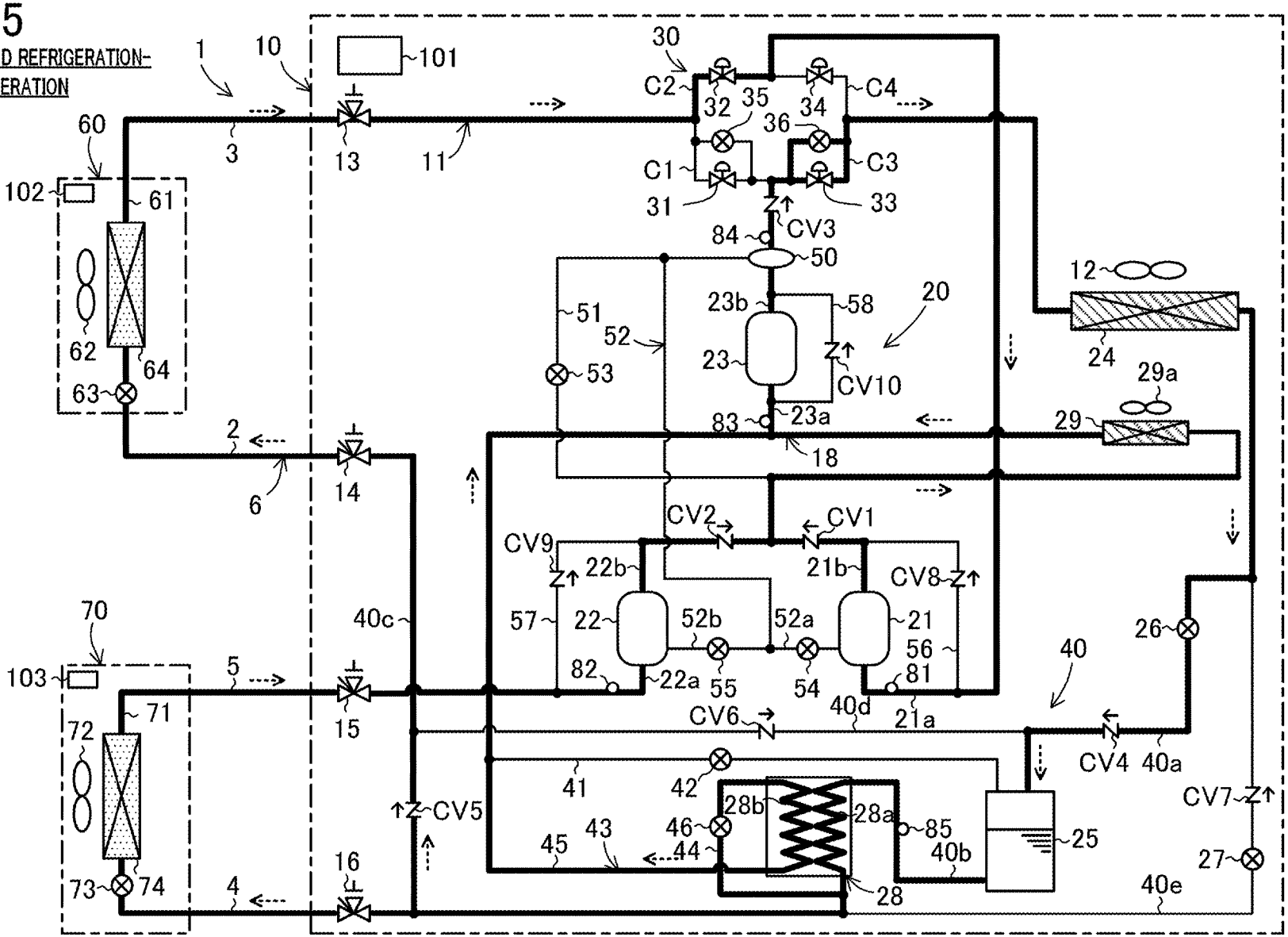
FIG. 5 illustrates a flow of a refrigerant during a cooling and refrigeration-facility operation in the refrigeration apparatus illustrated in FIG. 1.

In the cooling and refrigeration-facility operation illustrated in FIG. 5, the controller (100) closes the first, fourth, and fifth on-off valves (31), (34), and (35), and opens the second on-off valve (32) and the third and/or sixth on-off valve (33) and/or (36). The controller (100) operates the first, second, and third compressors (21), (22), and (23). The controller (100) opens the first outdoor expansion valve (26) and the injection valve (46) to a predetermined opening degree, and closes the second outdoor expansion valve (27). The controller (100) adjusts the opening degrees of the indoor expansion valve (63) and the refrigeration-facility expansion valve (73). The controller (100) operates the outdoor fan (12), the indoor fan (62), and the refrigeration-facility fan (72).

In the cooling and refrigeration-facility operation, the refrigeration cycle is performed in which the outdoor heat exchanger (24) functions as a radiator, and the indoor heat exchanger (64) and the refrigeration-facility heat exchanger (74) function as evaporators.

Specifically, the refrigerant compressed by the first and second compressors (21) and (22) is cooled in the intercooler (29), and is then sucked into the third compressor (23). The refrigerant compressed to a pressure equal to or greater than the critical pressure by the third compressor (23) dissipates heat in the outdoor heat exchanger (24), and then passes through the first outdoor expansion valve (26). The first outdoor expansion valve (26) decompresses the refrigerant to a pressure less than the critical pressure.

The refrigerant in a subcritical state flows into the receiver (25). The receiver (25) separates the refrigerant into a gas refrigerant and a liquid refrigerant.

The liquid refrigerant separated in the receiver (25) is cooled in the cooling heat exchanger (28) by the refrigerant flowing through the injection flow path (43). The refrigerant in the injection flow path (43) is sent to the intermediate flow path (18).

The refrigerant cooled by the cooling heat exchanger (28) is sent to the air-conditioning unit (60) and the refrigeration-facility unit (70).

The refrigerant sent to the air-conditioning unit (60) is decompressed by the indoor expansion valve (63), and then evaporates in the indoor heat exchanger (64). As a result, the indoor air is cooled. The refrigerant that has evaporated in the indoor heat exchanger (64) is sucked into the first compressor (21), and is then compressed again.

The refrigerant sent to the refrigeration-facility unit (70) is decompressed by the refrigeration-facility expansion valve (73), and then evaporates in the refrigeration-facility heat exchanger (74). As a result, the inside air is cooled. The refrigerant that has evaporated in the cooling heat exchanger (28) is sucked into the second compressor (22), and is then compressed again.

<Heating Operation>

Figure 6:
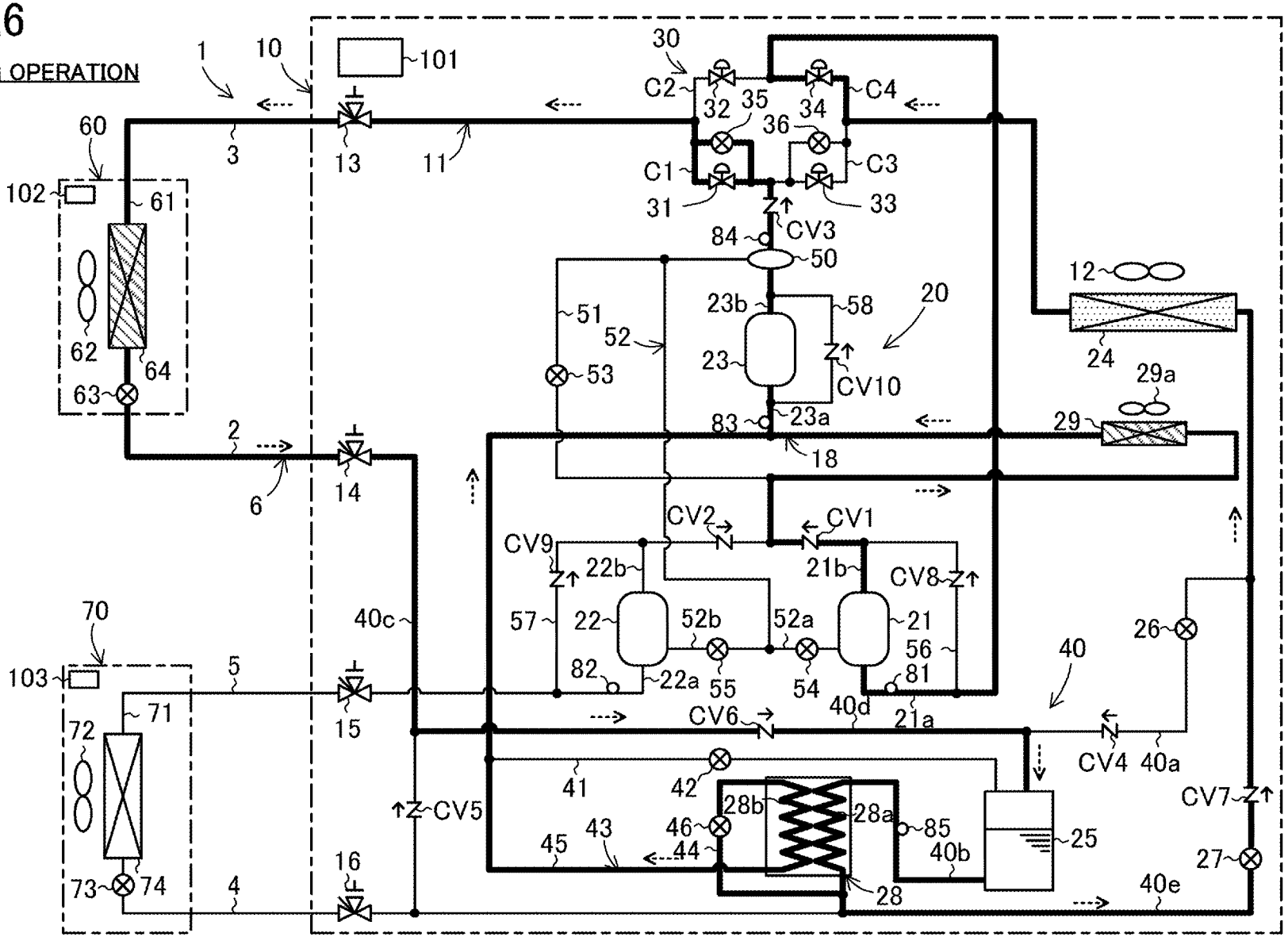
FIG. 6 illustrates a flow of a refrigerant during a heating operation in the refrigeration apparatus illustrated in FIG. 1.

In the heating operation illustrated in FIG. 6, the controller (100) closes the second, third, and sixth on-off valves (32), (33), and (36), and opens the first and/or fifth on-off valve (31) and/or (35) and the fourth on-off valve (34). The controller (100) pauses the second compressor (22), and operates the first and third compressors (21) and (23). The controller (100) opens the second outdoor expansion valve (27) and the injection valve (46) to a predetermined opening degree, and closes the first outdoor expansion valve (26). The controller (100) closes the refrigeration-facility expansion valve (73), and adjusts the opening degree of the indoor expansion valve (63). The controller (100) operates the outdoor fan (12) and the indoor fan (62), and pauses the refrigeration-facility fan (72).

In the heating operation, the refrigeration cycle is performed in which the indoor heat exchanger (64) functions as a radiator, the outdoor heat exchanger (24) functions as an evaporator, and the function of the refrigeration-facility heat exchanger (74) is substantially disabled.

Specifically, the refrigerant compressed by the first compressor (21) is cooled in the intercooler (29), and is then sucked into the third compressor (23). The refrigerant compressed by the third compressor (23) is sent to the air-conditioning unit (60).

The refrigerant sent to the air-conditioning unit (60) dissipates heat in the indoor heat exchanger (64). As a result, the indoor air is heated. The refrigerant that has dissipated heat in the indoor heat exchanger (64) flows into the receiver (25). The receiver (25) separates the refrigerant into a gas refrigerant and a liquid refrigerant.

The liquid refrigerant separated in the receiver (25) is cooled in the cooling heat exchanger (28) by the refrigerant flowing through the injection flow path (43). The refrigerant in the injection flow path (43) is sent to the intermediate flow path (18).

The refrigerant that has been cooled by the cooling heat exchanger (28) is decompressed by the second outdoor expansion valve (27), and then evaporates in the outdoor heat exchanger (24). The refrigerant that has evaporated in the outdoor heat exchanger (24) is sucked into the first compressor (21), and is then compressed again.

<Heating and Refrigeration-Facility Operation>

Figure 7:
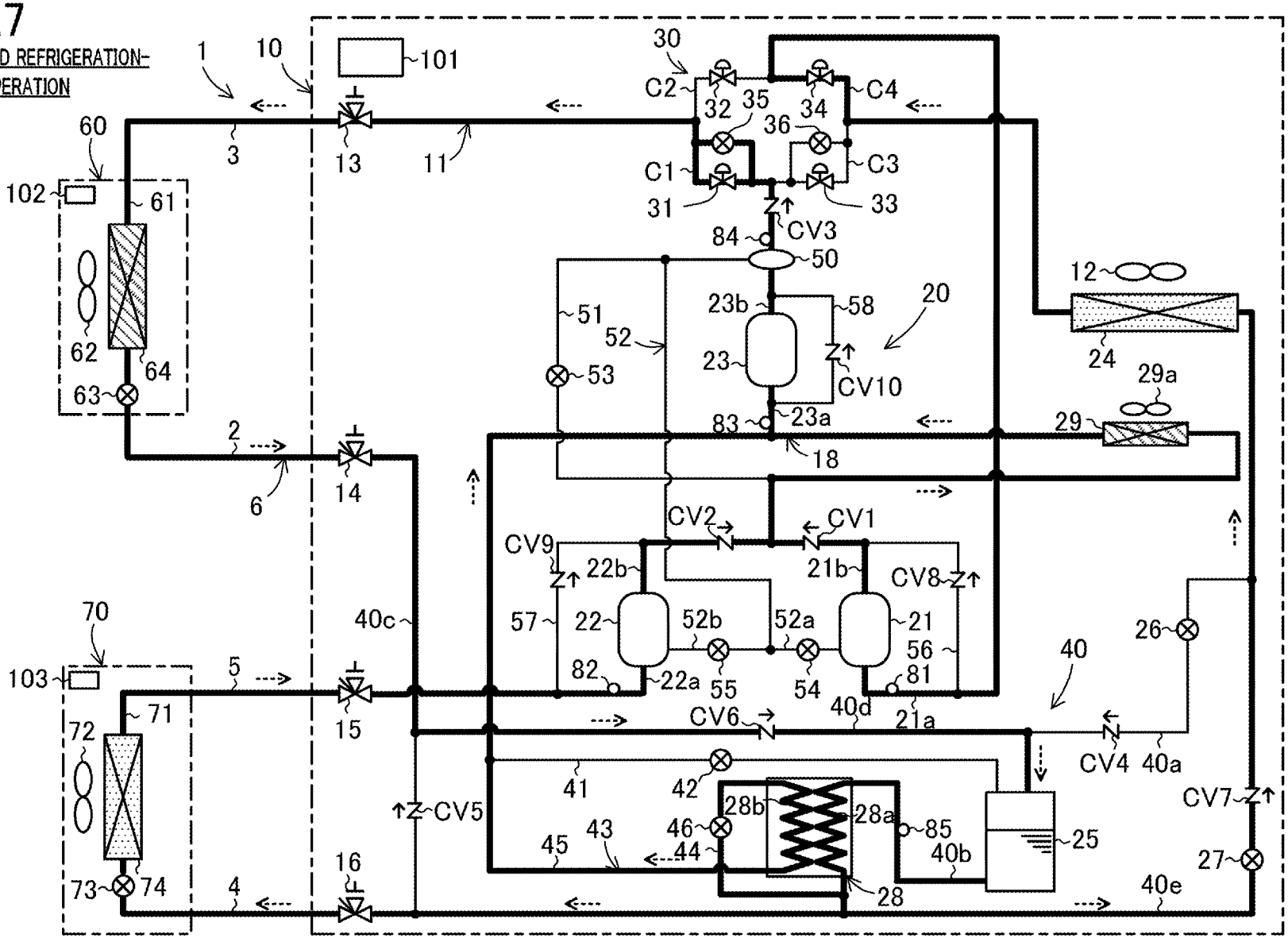
FIG. 7 illustrates a flow of a refrigerant during a heating and refrigeration-facility operation in the refrigeration apparatus illustrated in FIG. 1.

In the heating and refrigeration-facility operation illustrated in FIG. 7, the controller (100) closes the second, third, and sixth on-off valves (32), (33), and (36), and opens the first and/or fifth on-off valve (31) and/or (35) and the fourth on-off valve (34). The controller (100) operates the first, second, and third compressors (21), (22), and (23). The controller (100) opens the second outdoor expansion valve (27) and the injection valve (46) to a predetermined opening degree, and closes the first outdoor expansion valve (26). The controller (100) adjusts the opening degrees of the indoor expansion valve (63) and the refrigeration-facility expansion valve (73). The controller (100) operates the outdoor fan (12), the indoor fan (62), and the refrigeration-facility fan (72).

In the heating and refrigeration-facility operation, the refrigeration cycle is performed in which the indoor heat exchanger (64) functions as a radiator, and the outdoor heat exchanger (24) and the refrigeration-facility heat exchanger (74) function as evaporators.

Specifically, the refrigerant compressed by the first and second compressors (21) and (22) is cooled in the intercooler (29), and is then sucked into the third compressor (23). The refrigerant compressed by the third compressor (23) is sent to the air-conditioning unit (60).

The refrigerant sent to the air-conditioning unit (60) dissipates heat in the indoor heat exchanger (64). As a result, the indoor air is heated. The refrigerant that has dissipated heat in the indoor heat exchanger (64) flows into the receiver (25). The receiver (25) separates the refrigerant into a gas refrigerant and a liquid refrigerant.

The liquid refrigerant separated in the receiver (25) is cooled in the cooling heat exchanger (28) by the refrigerant flowing through the injection flow path (43). The refrigerant in the injection flow path (43) is sent to the intermediate flow path (18).

A portion of the refrigerant that has been cooled by the cooling heat exchanger (28) is decompressed by the second outdoor expansion valve (27), and then evaporates in the outdoor heat exchanger (24). The refrigerant that has evaporated in the outdoor heat exchanger (24) is sucked into the first compressor (21), and is then compressed again.

The remaining portion of the refrigerant that has been cooled by the cooling heat exchanger (28) is sent to the refrigeration-facility unit (70). The refrigerant sent to the refrigeration-facility unit (70) is decompressed by the refrigeration-facility expansion valve (73), and then evaporates in the refrigeration-facility heat exchanger (74). As a result, the inside air is cooled. The refrigerant that has evaporated in the refrigeration-facility heat exchanger (74) is sucked into the second compressor (22), and is then compressed again.

—Operation For Evaluating Amount Of Refrigerant—

The operation of the refrigeration apparatus (1) includes an operation for evaluating the amount of the refrigerant (hereinafter referred to as the refrigerant amount evaluation operation). In this embodiment, after a test operation has been performed for the above-described refrigeration-facility operation, cooling operation, cooling and refrigeration-facility operation, heating operation, or heating and refrigeration-facility operation, the refrigerant amount evaluation operation is performed. In the test operation, the compression element (20) is operated to send the refrigerant to the utilization-side units (60, 70). Meanwhile, in the refrigerant amount evaluation operation, while the circulation of the refrigerant through the utilization-side units (60, 70) is paused, the compression element (20) is operated to circulate the refrigerant through the heat-source-side unit (10) to evaluate the amount of the refrigerant.

An outline of the refrigerant amount evaluation operation will be described with reference to FIG. 8. In the drawing, the directions of flows of the refrigerant are indicated by broken arrows, and the flow paths through each of which the refrigerant flows are thickened. In the drawing, the heat exchanger serving as a radiator is hatched.

Figure 8:
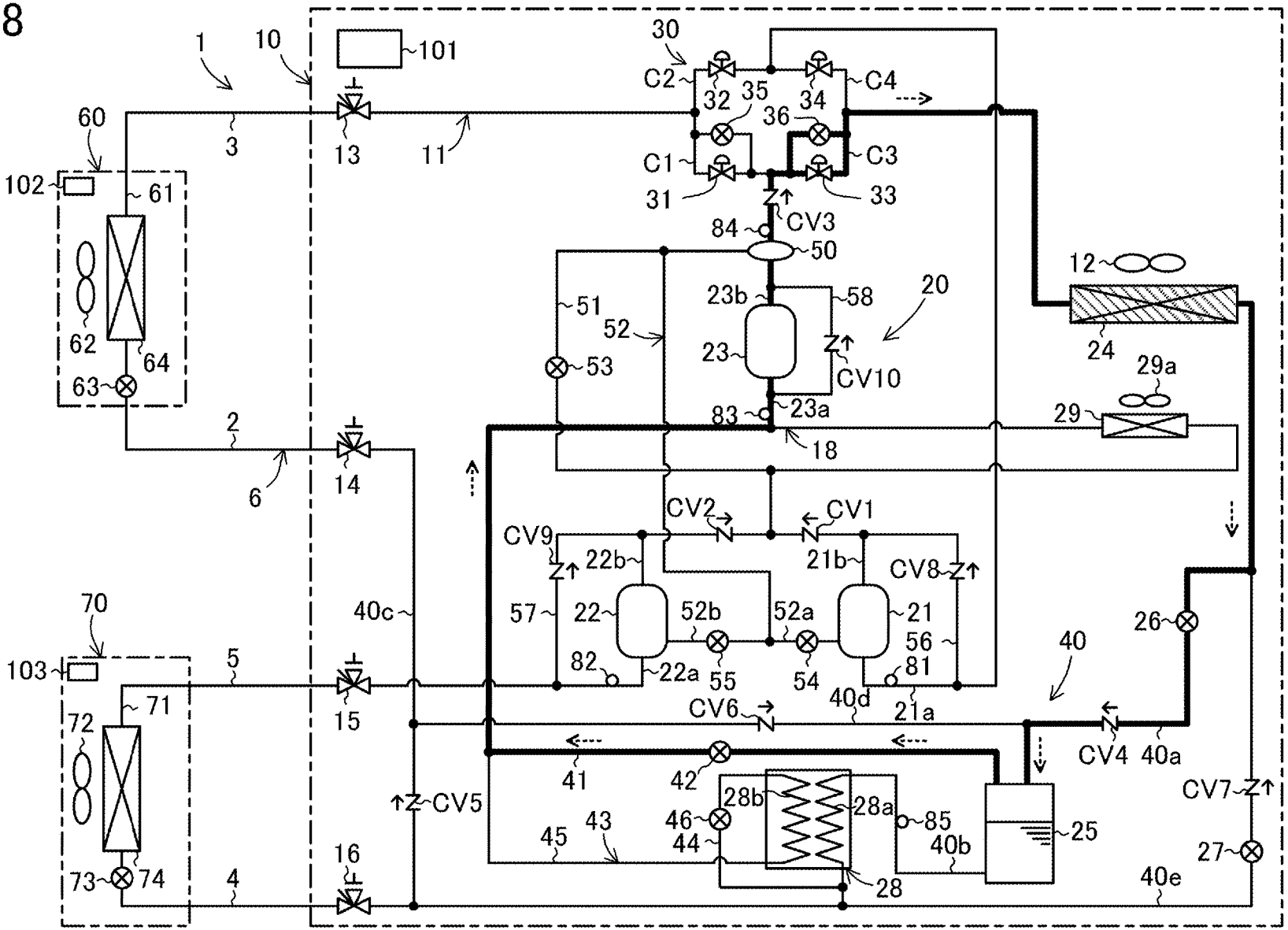
FIG. 8 further illustrates a flow of a refrigerant during evaluation of the amount of a refrigerant in the refrigeration apparatus illustrated in FIG. 1.

In the refrigerant amount evaluation operation illustrated in FIG. 8, after the end of the test operation, the outdoor controller (101) closes the first gas shut-off valve (13), the first liquid shut-off valve (14), the second gas shut-off valve (15), and the second liquid shut-off valve (16) to pause the circulation of the refrigerant through the utilization-side units (60, 70). Furthermore, the outdoor controller (101) may fully close the indoor expansion valve (63) and the refrigeration-facility expansion valve (73), i.e., the utilization-side expansion valves (63, 73), and pause the indoor fan (62) and the refrigeration-facility fan (72), through the indoor controller (102) and the refrigeration-facility controller (103).

The outdoor controller (101) closes the first, second, fourth, and fifth on-off valves (31), (32), (34), and (35), and opens the third and/or sixth on-off valve (33) and/or (36). The outdoor controller (101) pauses the first and second compressors (21) and (22), i.e., the low-stage compressors (21, 22), and operates the third compressor (23), i.e., the high-stage compressor (23). The outdoor controller (101) opens the first outdoor expansion valve (26) and the venting valve (42) to a predetermined opening degree, and closes the second outdoor expansion valve (27). The outdoor controller (101) operates the outdoor fan (12).

In the refrigerant amount evaluation operation, the outdoor heat exchanger (24) functions as a radiator, and the functions of the indoor heat exchanger (64) and the refrigeration-facility heat exchanger (74) are substantially disabled.

Specifically, the refrigerant compressed to a pressure equal to or greater than the critical pressure by the third compressor (23) dissipates heat in the outdoor heat exchanger (24), and then passes through the first outdoor expansion valve (26). The first outdoor expansion valve (26) decompresses the refrigerant.

The decompressed refrigerant flows into the receiver (25). The receiver (25) separates the refrigerant into a gas refrigerant and a liquid refrigerant.

The gas refrigerant separated in the receiver (25) flows through the venting pipe (41), is sent to the intermediate flow path (18), i.e., to the third suction pipe (23*a*) of the third compressor (23), is sucked into the third compressor (23), and is compressed again.

In the refrigerant amount evaluation operation, while the refrigerant is circulated through the high-stage compressor (23), the outdoor heat exchanger (heat-source-side heat exchanger) (24), the first outdoor expansion valve (26), the venting pipe (joint pipe) (41), and the high-stage compressor (23) in this order in the heat-source-side unit (10) as described above, the amount of the refrigerant is evaluated by a method to be described later. During the circulation of the refrigerant in the heat-source-side unit (10) in the refrigerant amount evaluation operation, the refrigerant dissipating heat in the outdoor heat exchanger (24) gradually lowers the temperature of the refrigerant flowing into the receiver (25).

—Method for Evaluating Amount of Refrigerant—

A method for evaluating the amount of a refrigerant in a refrigeration apparatus according to this embodiment will be described below with reference to FIGS. 9 to 13.

Figure 9:
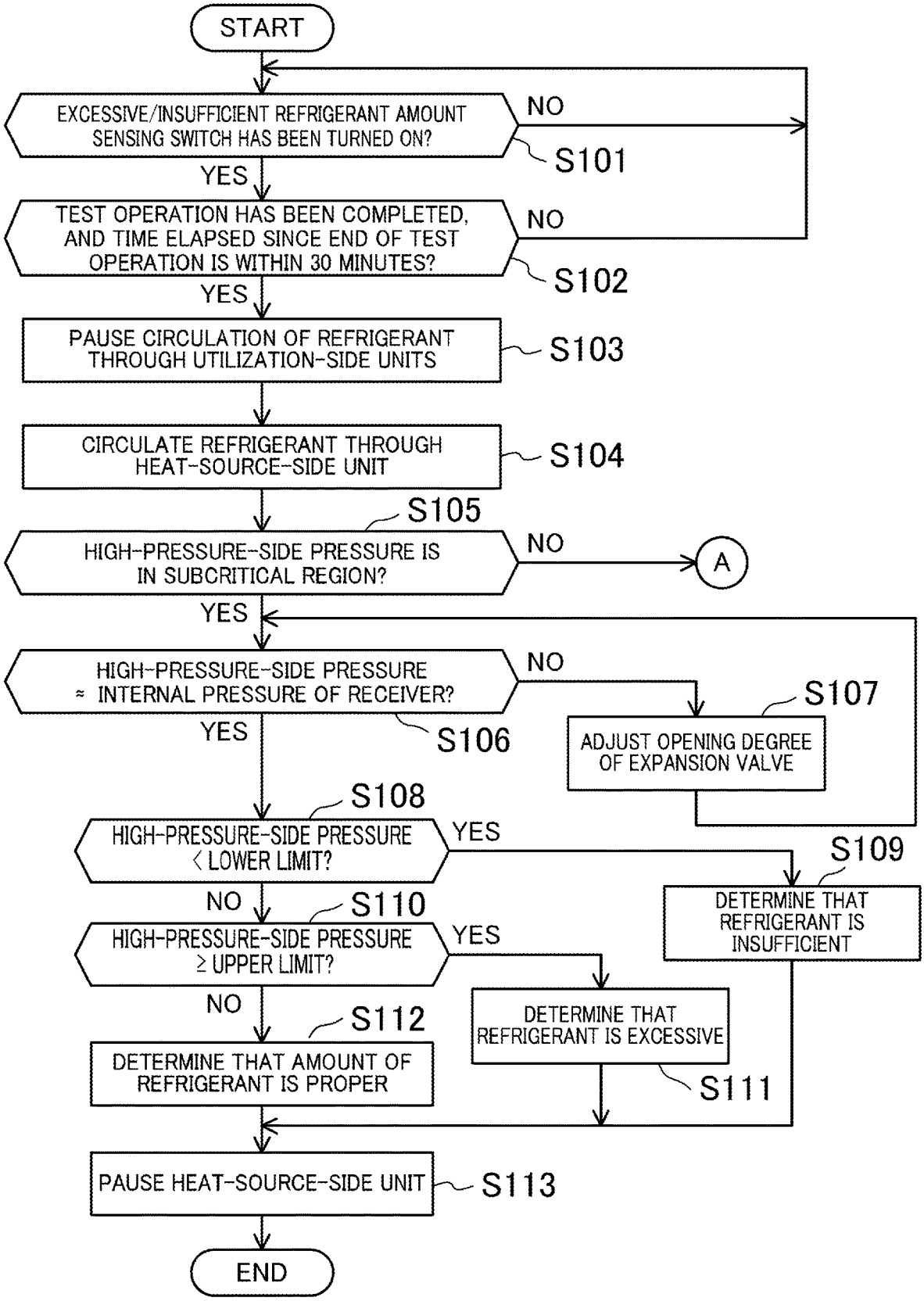
FIG. 9 is a first flowchart showing a method for evaluating the amount of a refrigerant in the refrigeration apparatus according to the embodiment.

As shown in FIG. 9, first, in step S101, the outdoor controller (control unit) (101) determines whether or not a switch for sensing an excessive/insufficient refrigerant amount has been turned ON. The switch for sensing an excessive/insufficient refrigerant amount may be configured as an input device, such as a touch panel included in the controller (100).

If the switch for sensing an excessive/insufficient refrigerant amount has been turned ON, the control unit (101) determines whether or not the test operation has been completed and the time elapsed since the end of the test operation is within a predetermined time (e.g., 30 minutes), in step S102. If the switch for sensing an excessive/insufficient refrigerant amount has not been turned ON, the process returns to step S101.

The control unit (101) may end the test operation when it is determined that the state of the refrigerant during the test operation has been stabilized. Examples of the conditions that allow the determination that the state of the refrigerant during the test operation has been stabilized include "whether a predetermined time has elapsed since the start of the test operation," "whether the temperature of air blown out from each of the utilization-side units (60, 70) is equal to or lower than a predetermined temperature (in the case of cooling) (in the case of heating, whether the temperature of air blown out from each of the utilization-side units (60, 70) is higher than or equal to the predetermined temperature), "whether an abnormality code has not been issued" and "whether the temperature of the suction pipe of the compression element (20) is within a predetermined range." The heat-source-side unit (10) may further include a means for sensing the quantity of state of the refrigerant, and the control unit (101) may determine whether such a condition as described above has been satisfied, based on the value obtained by the means. This allows the means for sensing the quantity of state of the refrigerant to easily determine that the state of the refrigerant in the refrigerant circuit (6) has been stabilized.

If a determination is made in step S102 that the test operation has been completed and that the time elapsed since the end of the test operation is within the predetermined time, the control unit (101) pauses the circulation of the refrigerant through the utilization-side units (60, 70) in step S103. On the other hand, if a determination is made in step S102 that the test operation has not been completed or that the time elapsed since the end of the test operation exceeds the predetermined time, the process returns to step S101.

Specifically, in step S103, the control unit (101) closes the first gas shut-off valve (13), the first liquid shut-off valve (14), the second gas shut-off valve (15), and the second liquid shut-off valve (16). Furthermore, the control unit (101) fully closes the indoor expansion valve (63) and the refrigeration-facility expansion valve (73), i.e., the utilization-side expansion valves (63, 73), and pauses the indoor fan (62) and the refrigeration-facility fan (72), through the indoor controller (102) and the refrigeration-facility controller (103). Thus, the circulation of the refrigerant through the utilization-side units (60, 70) is paused.

Next, in step S104, the control unit (101) operates the compression element (20) to circulate the refrigerant through the heat-source-side unit (10), while pausing the circulation of the refrigerant through the utilization-side units (60, 70). Thus, the refrigerant amount evaluation operation is started.

Specifically, in step S104, the control unit (101) closes the first, second, fourth, and fifth on-off valves (31), (32), (34), and (35), and opens the third and/or sixth on-off valve (33) and/or (36). The control unit (101) pauses the first and second compressors (21) and (22), i.e., the low-stage compressors (21, 22), and operates the third compressor (23), i.e., the high-stage compressor (23). The control unit (101)

opens the first outdoor expansion valve (26) and the venting valve (42) to a predetermined opening degree, and closes the second outdoor expansion valve (27). In addition, the control unit (101) operates the outdoor fan (12). Thus, the refrigerant circulates through the high-stage compressor (23), the outdoor heat exchanger (heat-source-side heat exchanger) (24), the first outdoor expansion valve (26), the venting pipe (joint pipe) (41), and the high-stage compressor (23) in this order in the heat-source-side unit (10).

Next, in step S105, the control unit (101) determines whether the high-pressure-side pressure (HP), e.g., the discharge pressure of the compression element (20), is in the subcritical region (in other words, whether the high-pressure-side pressure (HP) is less than the supercritical pressure or greater than or equal to the supercritical pressure). The high-pressure-side pressure (HP) is detected by the fourth pressure sensor (84), and the detection result is transmitted to the control unit (101).

If a determination is made in step S105 that the high-pressure-side pressure (HP) is in the subcritical region (less than the supercritical pressure), a first evaluation operation in steps S106 to S112 to be described later is performed. If a determination is made in step S105 that the high-pressure-side pressure (HP) is not in the subcritical region (greater than or equal to the supercritical pressure), a second evaluation operation in and after step S201 to be described later (see FIGS. 10 to 12) is performed. In the present disclosure, the first evaluation operation may be referred to also as the "second operation," and the second evaluation operation may be referred to also as the "first operation."

<First Evaluation Operation>

In the first evaluation operation, first, in step S106, the control unit (101) determines whether the high-pressure-side pressure (HP) is substantially equal to the internal pressure (RP) of the receiver (25). The internal pressure (RP) of the receiver (25) is detected by the fifth pressure sensor (85), and the detection result is transmitted to the control unit (101). The determination condition in step S106 is basically "the internal pressure (RP) of the receiver (25)=the high-pressure-side pressure (HP)," but actually includes "the internal pressure (RP) of the receiver (25) the high-pressure-side pressure (HP)" in consideration of a measurement error and variations in the refrigerant state.

If a determination is made in step S106 that the high-pressure-side pressure (HP) is not substantially equal to the internal pressure (RP) of the receiver (25), the control unit (101) gradually adjusts the opening degree of the first outdoor expansion valve (26) so that the internal pressure (RP) of the receiver (25) approaches the high-pressure-side pressure (HP), in step S107. Step S107 is repeated until a determination is made in step S106 that the high-pressure-side pressure (HP) is substantially equal to the internal pressure (RP) of the receiver (25). For example, if the opening degree of the first outdoor expansion valve (26) is set to be slightly smaller to prevent the internal pressure (RP) of the receiver (25) from increasing excessively at the start of the refrigerant amount evaluation operation, the first outdoor expansion valve (26) is gradually opened until the internal pressure (RP) of the receiver (25) becomes substantially equal to the high-pressure-side pressure (HP), and if necessary, the first outdoor expansion valve (26) is fully opened.

If a determination is made in step S106 that the high-pressure-side pressure (HP) is substantially equal to the internal pressure (RP) of the receiver (25), the control unit (101) determines, in step S108, whether the high-pressure-side pressure (HP) is less than a predetermined lower limit thereof.

If a determination is made in step S108 that the high-pressure-side pressure (HP) is less than the predetermined lower limit, the control unit (101) determines in step S109 that the amount of the refrigerant is insufficient.

If a determination is made in step S108 that the high-pressure-side pressure (HP) is not less than the predetermined lower limit, the control unit (101) determines, in step S110, whether the high-pressure-side pressure (HP) is greater than or equal to a predetermined upper limit thereof.

If a determination is made in step S110 that the high-pressure-side pressure (HP) is greater than or equal to the predetermined upper limit, the control unit (101) determines in step S111 that the amount of the refrigerant is excessive.

If a determination is made in step S110 that the high-pressure-side pressure (HP) is not greater than or equal to the predetermined upper limit, the control unit (101) determines in step S112 that the amount of the refrigerant is proper.

Each of the predetermined lower limit and the predetermined upper limit may be determined based on the outdoor air temperature (Ta). This allows the amount of the refrigerant to be more accurately evaluated in consideration of the outdoor air temperature (Ta).

Figure 13:
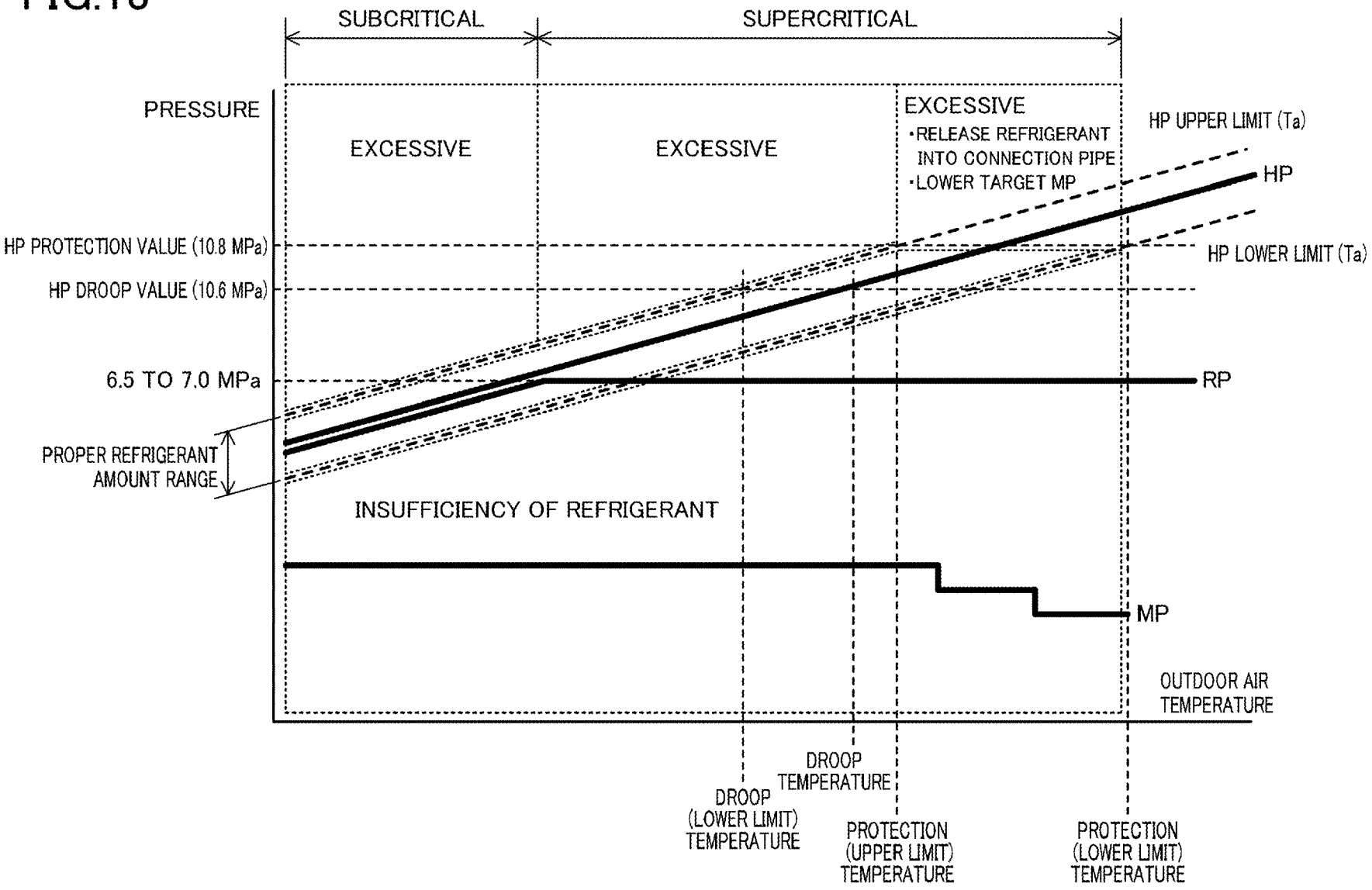
FIG. 13 is a schematic diagram illustrating exemplary evaluation criteria in the method for evaluating the amount of the refrigerant in the refrigeration apparatus according to the embodiment.

FIG. 13 shows criteria for evaluating the amount of the refrigerant in the first evaluation operation described above. The horizontal axis of FIG. 13 indicates the outdoor air temperature (Ta), and the vertical axis of FIG. 13 indicates a pressure, such as the high-pressure-side pressure (HP) or the internal pressure (RP) of the receiver (25). Suppose that the HP is in the subcritical region. In that case, as shown in FIG. 13, on condition that the HP be substantially equal to the RP, if the HP is within a predetermined range (greater than or equal to the HP lower limit and less than the HP upper limit), the amount of the refrigerant is determined to be proper; if the HP is greater than the predetermined range, the amount of the refrigerant is determined to be excessive; and if the HP is less than the predetermined range, the amount of the refrigerant is determined to be insufficient.

After the refrigerant amount evaluation (first evaluation operation) has been performed in step S109, S111, or S112, the control unit (101) pauses the heat-source-side unit (10), i.e., the high-stage compressor (23), to end the refrigerant amount evaluation operation, in step S113.

<Second Evaluation Operation>

Figure 10:
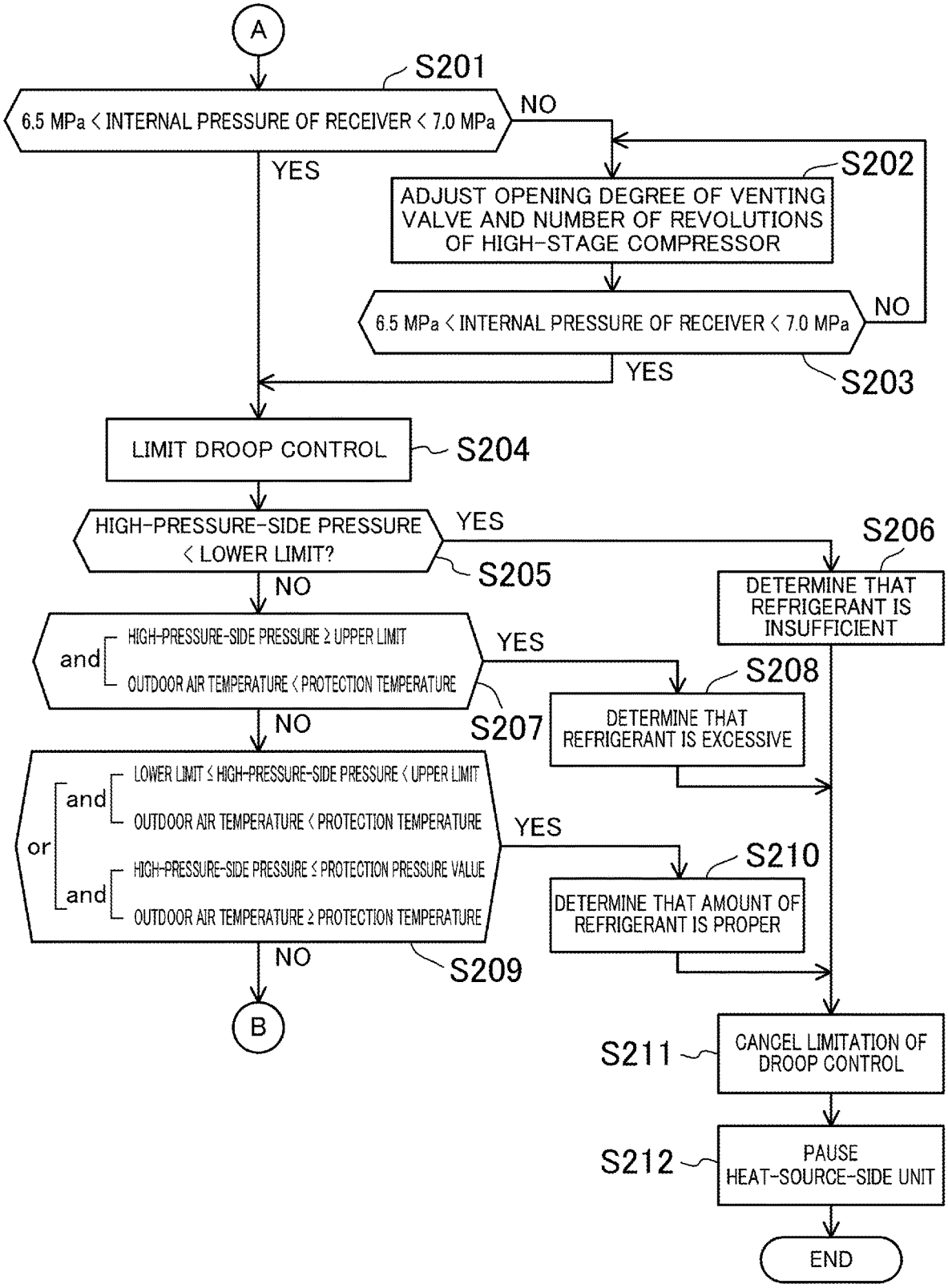
FIG. 10 is a second flowchart showing the method for evaluating the amount of the refrigerant in the refrigeration apparatus according to the embodiment.

In the second evaluation operation performed if a determination is made in step S105 that the HP is greater than or equal to the supercritical pressure, first, in step S201, the control unit (101) determines whether or not the RP is equal to or less than the supercritical pressure (specifically, whether the RP is within a first pressure range in which pressures are equal to or less than the supercritical pressure (e.g., 6.5 MPa<RP<7.0 MPa)), as shown in FIG. 10.

If a determination is made in step S201 that the RP is not within the first pressure range, the control unit (101) adjusts the RP through adjustment of the opening degree of the venting valve (42) and/or through adjustment of the number of revolutions of the third compressor (high-stage compressor) (23) or through any other process in step S202. Subsequently, in step S203, the control unit (101) redetermines whether or not the RP is within the first pressure range. Step S202 is repeated until a determination is made in step S203 that the RP is within the first pressure range.

If a determination is made in step S201 or S203 that the RP is within the first pressure range, the control unit (101) limits droop control performed during a normal operation in step S204. The droop control as used herein refers to control that forcibly reduces the number of revolutions of the compression element (20) remaining in operation when the temperature of the discharge pipe of the compression element (20) reaches a predetermined droop temperature, so as to prevent the compression element (20) from continuing to operate for a long time with the motor of the compression element (20) overheated.

Next, in step S205, the control unit (101) determines whether or not the HP is less than the predetermined lower limit.

If a determination is made in step S205 that the HP is less than the predetermined lower limit, the control unit (101) determines in step S206 that the amount of the refrigerant is insufficient.

If a determination is made in step S205 that the HP is not less than the predetermined lower limit, the control unit (101) determines, in step S207, whether the HP is greater than or equal to the predetermined upper limit and the outdoor air temperature (Ta) is lower than a protection temperature. The protection temperature is the temperature at which the compression element (20) is paused for safety. Each of the predetermined lower limit and the predetermined upper limit may be determined based on the outdoor air temperature (Ta). This allows the amount of the refrigerant to be more accurately evaluated in consideration of the outdoor air temperature (Ta).

If a determination is made in step S207 that the HP is greater than or equal to the predetermined upper limit and that the Ta is lower than the protection temperature, the control unit (101) determines in step S208 that the amount of the refrigerant is excessive.

If a determination is made in step S207 that the HP is not greater than or equal to the predetermined upper limit or that the Ta is not lower than the protection temperature, the control unit (101) determines, in step S209, whether the HP is greater than or equal to the predetermined lower limit and less than the predetermined upper limit and the Ta is lower than the protection temperature. This determination is a first condition determination.

If a determination is made in the first condition determination in step S209 that the HP is greater than or equal to the predetermined lower limit and less than the predetermined upper limit and that the Ta is lower than the protection temperature, the control unit (101) determines in step S210 that the amount of the refrigerant is proper.

Furthermore, in step S209, the control unit (101) determines whether the HP is equal to or less than a protection pressure value and the Ta is higher than or equal to the protection temperature. This determination is a second condition determination. The protection pressure value refers to the pressure at which the compression element (20) (the high-stage compressor (23)) is paused for safety, and is, for example, 10.8 MPa.

If a determination is made in the second condition determination in step S209 that the HP is equal to or less than the protection pressure value and that the Ta is higher than or equal to the protection temperature, the control unit (101) determines in step S210 that the amount of the refrigerant is proper.

FIG. 13 shows criteria for evaluating the amount of the refrigerant in the second evaluation operation described above. The horizontal axis of FIG. 13 indicates the Ta, and the vertical axis of FIG. 13 indicates the pressure, such as the HP or the RP. Suppose that the HP is in the supercritical region. In that case, as shown in FIG. 13, on condition that the RP be within the first pressure range in which pressures are equal to or less than the supercritical pressure (e.g., 6.5 MPa<RP<7.0 MPa), if the HP is less than the predetermined range (greater than or equal to the HP lower limit and less than the HP upper limit), the amount of the refrigerant is determined to be insufficient; if the Ta is lower than the protection temperature (specifically, the protection upper-limit temperature at which the HP upper limit is equal to the protection pressure value (HP protection value)), and the HP is greater than the predetermined range, the amount of the refrigerant is determined to be excessive; and if the Ta is lower than the protection temperature, and the HP is within the predetermined range, the amount of the refrigerant is determined to be proper. In addition, if the HP is greater than or equal to the predetermined lower limit and equal to or less than the protection pressure value (HP protection value) even while the Ta is higher than or equal to the protection temperature, the amount of the refrigerant is determined to be proper.

After the refrigerant amount evaluation has been performed in step S206, S208, or S210, the control unit (101) cancels the limitation of the droop control in step S211. Subsequently, in step S212, the control unit (101) pauses the heat-source-side unit (10), i.e., the high-stage compressor (23), to end the refrigerant amount evaluation operation.

If, in step S209, neither of the conditions for the first and second condition determinations has been satisfied (in other words, if the HP is greater than the protection pressure value and the Ta is higher than or equal to the protection temperature), a first high-pressure reduction operation in and after step S301 to be described later (see FIG. 11) or a second high-pressure reduction operation in and after step S401 to be described later (see FIG. 12) is performed.

<First High-Pressure Reduction Operation>

Figure 11:
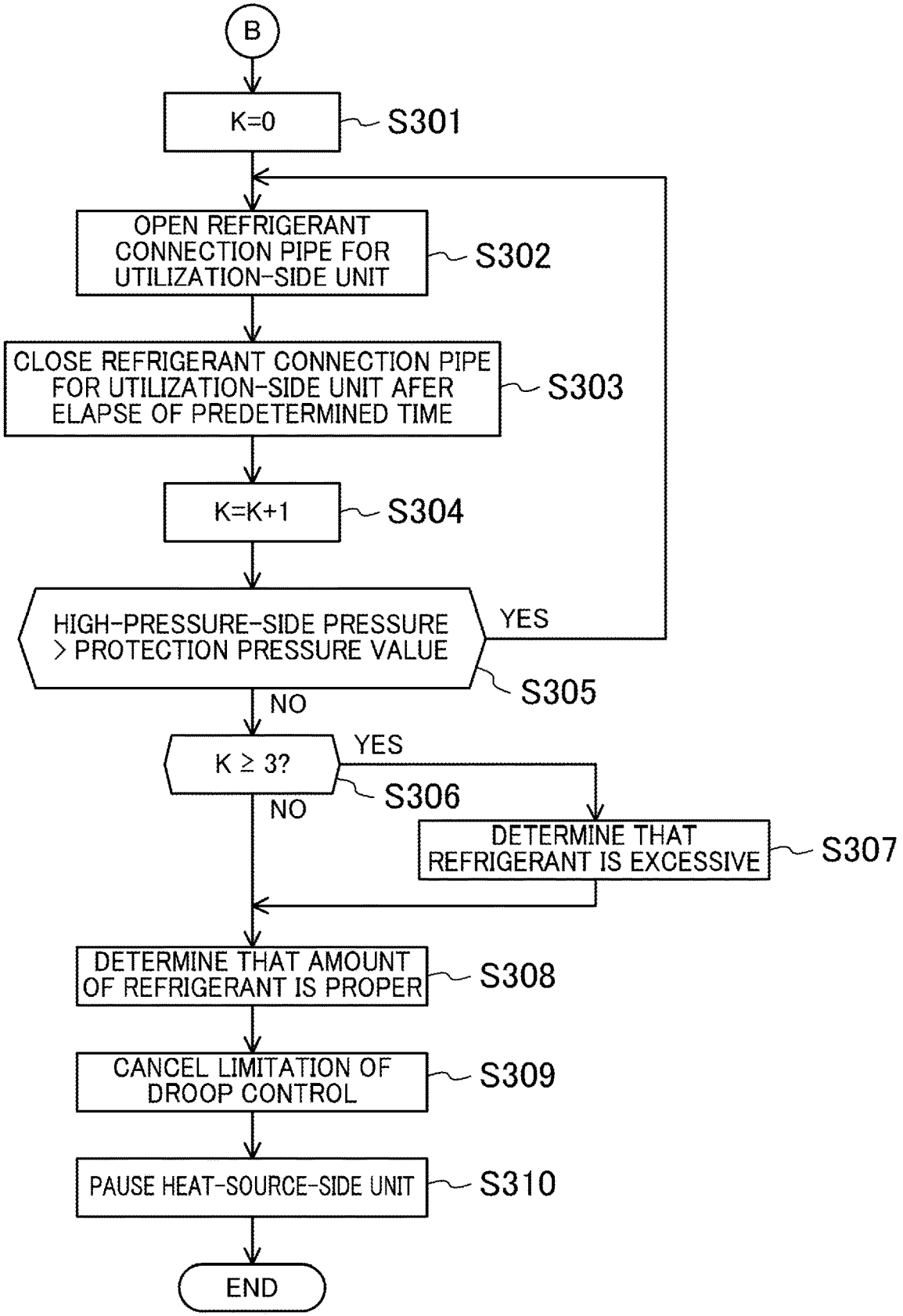
FIG. 11 is a third flowchart showing the method for evaluating the amount of the refrigerant in the refrigeration apparatus according to the embodiment.

In the first high-pressure reduction operation, as shown in FIG. 11, first, in step S301, the control unit (101) resets a counter (K) held in a memory or any other component to "0."

Next, in step S302, the control unit (101) opens the fifth on-off valve (35) in the operating state shown in FIG. 8 to release an excess of the refrigerant through the first flow path (C1) to the first gas connection pipe (3) corresponding to the air-conditioning unit (utilization-side unit) (60). As a result, the HP is lowered.

Next, in step S303, the control unit (101) closes the fifth on-off valve (35) after a lapse of a predetermined time (e.g., 5 seconds). Thus, the transfer of the refrigerant to the first gas connection pipe (3) corresponding to the air-conditioning unit (60) is paused.

Next, in step S304, the control unit (101) increments the value of the counter (K) by one, and stores the value in the memory or any other component.

Next, in step S305, the control unit (101) determines whether or not the HP is greater than the protection pressure value.

If a determination is made in step S305 that the HP is greater than the protection pressure value, the process returns to step S302.

If a determination is made in step S305 that the HP is equal to or less than the protection pressure value, the control unit (101) determines, in step S306, whether or not the counter (K) counts a value greater than or equal to a predetermined number (e.g., three).

If a determination is made in step S306 that the counter (K) counts a value greater than or equal to the predetermined number, the control unit (101) determines, in step 307, that the amount of the refrigerant is excessive.

If a determination is made in step S306 that the counter (K) does not count a value greater than or equal to the predetermined number, the control unit (101) determines, in step S308, that the amount of the refrigerant is proper.

FIG. 13 shows criteria for evaluating the amount of the refrigerant in the first high-pressure reduction operation described above. If the HP is greater than the protection pressure value, and the Ta is higher than or equal to the protection temperature, an excess of the refrigerant is released to the first gas connection pipe (3) corresponding to the air-conditioning unit (60) to reduce the HP to a value equal to or less than the protection pressure value. If, in this state, the amount of the excess of the refrigerant is small, the amount of the refrigerant is determined to be proper, and in other cases, the amount of the refrigerant is determined to be excessive, as shown in FIG. 13.

After the refrigerant amount evaluation has been performed in step S307 or S308, the control unit (101) cancels the limitation of the droop control in step S309. Subsequently, in step S310, the control unit (101) pauses the heat-source-side unit (10), i.e., the high-stage compressor (23), to end the refrigerant amount evaluation operation.

<Second High-Pressure Reduction Operation>

Figure 12:
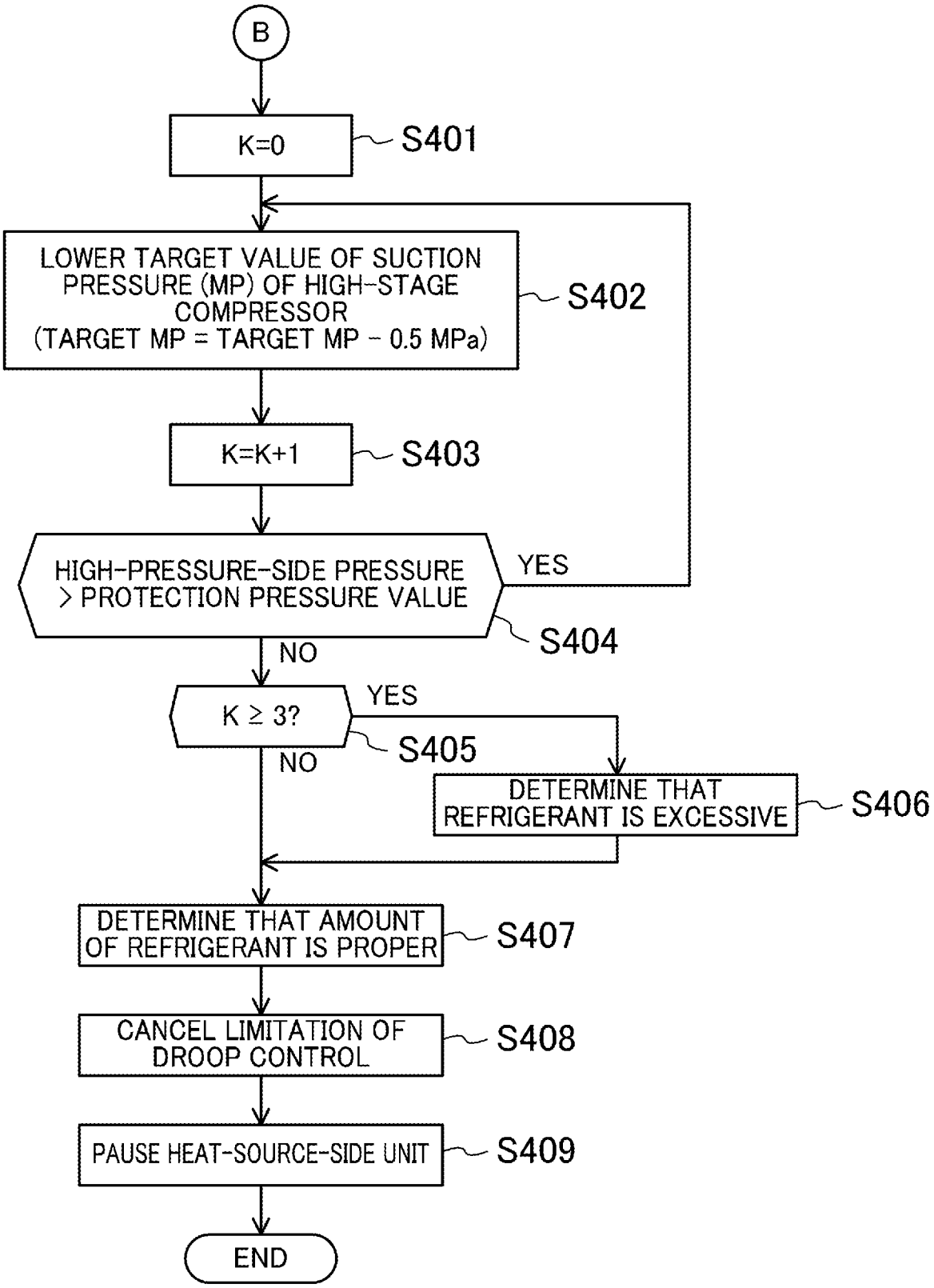
FIG. 12 is a fourth flowchart showing the method for evaluating the amount of the refrigerant in the refrigeration apparatus according to the embodiment.

In the second high-pressure reduction operation, as shown in FIG. 12, first, in step S401, the control unit (101) resets the counter (K) held in the memory or any other component to "0."

Next, in step S402, the control unit (101) reduces, for example, the number of revolutions of the high-stage compressor (23) to lower the target value of the suction pressure (intermediate pressure (MP)) of the high-stage compressor (23) by a predetermined value (e.g., 0.5 MPa). As a result, the HP is lowered.

Next, in step S403, the control unit (101) increments the value of the counter (K) by one, and stores the value in the memory or any other component.

Next, in step S404, the control unit (101) determines whether or not the HP is greater than the protection pressure value.

If a determination is made in step S404 that the HP is greater than the protection pressure value, the process returns to step S402.

If a determination is made in step S404 that the HP is equal to or less than the protection pressure value, the control unit (101) determines, in step S405, whether or not the counter (K) counts a value greater than or equal to a predetermined number (e.g., three).

If a determination is made in step S405 that the counter (K) counts a value greater than or equal to the predetermined number, the control unit (101) determines, in step 406, that the amount of the refrigerant is excessive.

If a determination is made in step S405 that the counter (K) does not count a value greater than or equal to the predetermined number, the control unit (101) determines, in step S407, that the amount of the refrigerant is proper.

FIG. 13 shows criteria for evaluating the amount of the refrigerant in the second high-pressure reduction operation described above. If the HP is greater than the protection pressure value, and the Ta is higher than or equal to the protection temperature, the target value of the suction pressure (MP) of the high-stage compressor (23) is lowered to reduce the HP to a value equal to or less than the protection pressure value. If, in this state, the decrement in the target value of the MP is small, the amount of the refrigerant is determined to be proper, and in other cases, the amount of the refrigerant is determined to be excessive, as shown in FIG. 13.

After the refrigerant amount evaluation has been performed in step S406 or S407, the control unit (101) cancels the limitation of the droop control in step S408. Subsequently, in step S409, the control unit (101) pauses the heat-source-side unit (10), i.e., the high-stage compressor (23), to end the refrigerant amount evaluation operation.

Features of Embodiment

The refrigeration apparatus (1) of this embodiment includes the heat-source-side unit (10) using the refrigerant that works in the supercritical region. The heat-source-side unit (10) includes the compression element (20) configured to compress the refrigerant, the heat-source-side heat exchanger (24), the expansion valve (first outdoor expansion valve) (26) provided downstream of the heat-source-side heat exchanger (24), the receiver (25) provided downstream of the expansion valve (26), and the control unit (outdoor controller) (101). On a first condition that the internal pressure (RP) of the receiver (25) be equal to or less than the supercritical pressure, the control unit (101) performs a second evaluation operation (first operation) for evaluating the amount of the refrigerant based on the high-pressure-side pressure (HP).

According to the refrigeration apparatus (1) of this embodiment, the amount of the refrigerant is evaluated based on the high-pressure-side pressure on the first condition that the internal pressure of the receiver (25) be equal to or less than the supercritical pressure. Thus, the amount of the refrigerant can be evaluated based on the high-pressure-side pressure in consideration of the refrigerant that is assumed to be stored in the receiver (25) in a two-phase state during an actual operation. This can improve the accuracy of the evaluation result.

Using the refrigerant that works in the supercritical region, such as carbon dioxide, dominantly affects the intermediate pressure and the liquid receiver pressure in addition to the high-pressure-side pressure (HP) and the low-pressure-side pressure during an action of the refrigerant circuit (6). Thus, even if the HP remains unchanged, the result of determining whether the amount of the refrigerant is excessive or insufficient varies depending on the refrigerant state in the liquid receiver corresponding to an operating condition. However, in this embodiment, the refrigerant amount evaluation is performed based on the HP value on the first condition that the internal pressure of the receiver (25) be equal to or less than the supercritical pressure. This improves the evaluation accuracy.

In the refrigeration apparatus (1) of this embodiment, the first condition may be the condition that the internal pressure (RP) of the receiver (25) be within a first pressure range in which pressures are equal to or less than the supercritical pressure (e.g., 6.5 MPa<RP<7.0 MPa).

This allows the amount of the refrigerant to be evaluated based on the HP on the condition that the RP be within the first pressure range. Thus, the refrigerant amount evaluation can be performed in more accurate consideration of the state of the refrigerant that is assumed to be stored in the receiver (25) in the two-phase state during an actual operation. This further improves the accuracy of the evaluation result.

In the refrigeration apparatus (1) of this embodiment, the heat-source-side unit (10) may further include the venting pipe (41) through which the gas refrigerant is to be released from the receiver (25), and the venting valve (42) provided in the venting pipe (41). The control unit (101) may adjust the opening degree of the venting valve (42) so that in the second evaluation operation, the RP is within the first pressure range.

This allows the RP to be adjusted within the first pressure range using the venting valve (42).

In the refrigeration apparatus (1) of this embodiment, the heat-source-side unit (10) may be connected to the utilization-side units (60, 70). The compression element (20) may include the low-stage compressors (21, 22) and the high-stage compressor (23) configured to compress the refrigerant compressed by the low-stage compressors (21, 22). The heat-source-side unit (10) may further include the venting pipe (41) through which the gas refrigerant in the receiver (25) is introduced into the suction pipe (23*a*) of the high-stage compressor (23). In the second evaluation operation, the control unit (101) may pause the low-stage compressors (21, 22) and operate the high-stage compressor (23) to circulate the refrigerant through the high-stage compressor (23), the heat-source-side heat exchanger (24), the expansion valve (26), the receiver (25), the venting pipe (41), and the high-stage compressor (23) in this order.

With this configuration, in the second evaluation operation, the low-stage compressors (21, 22) respectively associated with the utilization-side units (60, 70) are paused, and the high-stage compressor (23) is operated. Thus, the amount of the refrigerant can be evaluated in the state where the circulation of the refrigerant through the utilization-side units (60, 70) is paused and the refrigerant is circulated through the heat-source-side unit (10). This can reduce variations in the refrigerant state in the utilization-side units (60, 70) and other components during the evaluation of the amount of the refrigerant. Thus, an error in the evaluation result can be made smaller. In other words, while the refrigerant is circulated throughout the system so as to be kept in each of the connection pipes by an amount corresponding to the internal volume of the connection pipe, the amount of the refrigerant remaining in the heat-source-side unit (10) is used to determine whether the amount of the refrigerant is excessive or insufficient. This can reduce the error resulting from the influence of an ambient environment, such as the length of the connection pipe and the environment where the utilization-side units (60, 70) are installed. In addition, a determination can be made whether the amount of the refrigerant is excessive or insufficient, regardless of the on-site installation situation (such as the specifications of the connection pipes).

In the refrigeration apparatus (1) of this embodiment, in the second evaluation operation, if the HP is less than the predetermined lower limit (first predetermined value), the control unit (101) may determine that the amount of the refrigerant is insufficient, and if the HP is greater than or equal to the predetermined upper limit (second predetermined value), the control unit (101) may determine that the amount of the refrigerant is excessive.

This allows a determination to be made whether the amount of the refrigerant is insufficient or excessive, based on the HP.

In the refrigeration apparatus (1) of this embodiment, the control unit (101) may determine the first and second predetermined values based on the outdoor air temperature (Ta).

This allows the amount of the refrigerant to be more accurately evaluated in consideration of the Ta.

In the refrigeration apparatus (1) of this embodiment, the heat-source-side unit (10) may be connected to the utilization-side units (60, 70). If, in the second evaluation operation, the HP is greater than the protection pressure value, and the Ta is higher than or equal to the protection temperature, the control unit (101) may release an excess of the refrigerant to the first gas connection pipe (3) corresponding to the air-conditioning unit (60) for a predetermined time, and then may evaluate the amount of the refrigerant (the first high-pressure reduction operation).

This can avoid the situation where the HP becomes so high that the components of the refrigerant circuit are damaged, and the compression element (20) can be operated to evaluate the amount of the refrigerant.

In the refrigeration apparatus (1) of this embodiment, the compression element (20) may include the low-stage compressors (21, 22) and the high-stage compressor (23) configured to compress the refrigerant compressed by the low-stage compressors (21, 22). If, in the second evaluation operation, the HP is greater than the protection pressure value, and the Ta is higher than or equal to the protection temperature, the control unit (101) may lower the target value of the suction pressure (MP) of the high-stage compressor (23), and then may evaluate the amount of the refrigerant (the second high-pressure reduction operation).

This can avoid the situation where the HP becomes so high that the components of the refrigerant circuit are damaged, and the compression element (20) can be operated to evaluate the amount of the refrigerant.

In the refrigeration apparatus (1) of this embodiment, while the HP is greater than or equal to the supercritical pressure, the control unit (101) may perform the second evaluation operation (a first operation), and while the HP is less than the supercritical pressure, the control unit (101) may perform the first evaluation operation (a second operation) for evaluating the amount of the refrigerant on the condition that the internal pressure (RP) of the receiver (25) be substantially equal to the HP.

This allows the amount of the refrigerant to be appropriately evaluated in accordance with the HP.

In the refrigeration apparatus (1) of this embodiment, in the first evaluation operation, if the HP is less than the predetermined lower limit (third predetermined value), the control unit (101) may determine that the amount of the refrigerant is insufficient, and if the HP is greater than or equal to the predetermined upper limit (fourth predetermined value), the control unit (101) may determine that the amount of the refrigerant is excessive.

This allows a determination to be made whether the amount of the refrigerant is insufficient or excessive, based on the HP. The third and fourth predetermined values may be determined based on the outdoor air temperature (Ta). This allows the amount of the refrigerant to be more accurately evaluated in consideration of the Ta.

In the refrigeration apparatus (1) of this embodiment, the control unit (101) may adjust the opening degree of the expansion valve (first outdoor expansion valve) (26) to satisfy "the condition that the RP be substantially equal to the HP" in the first determination action.

This allows the RP to approach the HP using the expansion valve (26).

In the refrigeration apparatus (1) of this embodiment, the refrigerant may be carbon dioxide.

This allows the refrigeration cycle where the refrigerant works in the supercritical region to be performed.

The method for evaluating the amount of the refrigerant in the refrigeration apparatus (1) of this embodiment is a method for evaluating the amount of the refrigerant in the refrigeration apparatus (1) including the heat-source-side unit (10) using the refrigerant that works in the supercritical region. The heat-source-side unit (10) includes the compression element (20) configured to compress the refrigerant, the heat-source-side heat exchanger (24), the expansion valve (first outdoor expansion valve) (26) provided downstream of the heat-source-side heat exchanger (24), and the receiver (25) provided downstream of the expansion valve (26). In the method for evaluating the amount of the refrigerant in the refrigeration apparatus (1), the amount of the refrigerant is evaluated based on the HP on the first condition that the RP be equal to or less than the supercritical pressure.

According to the method for evaluating the amount of the refrigerant in the refrigeration apparatus (1) of this embodiment, the amount of the refrigerant is evaluated based on the HP on the first condition that the RP be equal to or less than the supercritical pressure. Thus, the amount of the refrigerant can be evaluated based on the HP in consideration of the refrigerant that is assumed to be stored in the receiver (25) in the two-phase state during an actual operation. This can improve the accuracy of the evaluation result.

Whether the amount of a refrigerant in a refrigeration apparatus is excessive or insufficient has been sensed in the following process (1) or (2).

(1) It is judged by an on-site operator, based on how a sight glass attached to the liquid pipe is sealed.

(2) The on-site operator determines that the suction pipe temperature, the degree of suction superheat, and the discharge pressure (high-pressure-side pressure) of a compressor are within the respective target ranges.

However, in the determination method (1) based on visual inspection through the sight glass, the determination result depends on the operator's view, and for example, the refrigeration apparatus may be unnecessarily overfilled with the refrigerant.

In the determination method (2), using a refrigerant that works in the supercritical region, such as a $CO_2$ refrigerant, causes the result of determining whether the amount of the refrigerant is excessive or insufficient to vary depending on the state of the refrigerant in the liquid receiver (receiver) corresponding to an operating condition, even if the high-pressure-side pressure HP value remains unchanged.

In contrast, the refrigeration apparatus of the present disclosure described above operates to evaluate the amount of the refrigerant on the first condition that the pressure of the receiver be equal to or less than the supercritical pressure. This allows the amount of the refrigerant to be more accurately evaluated.

Other Embodiments

In the foregoing embodiment, the control unit (101) pauses the circulation of the refrigerant through the utilization-side units (60, 70), and performs the refrigerant amount evaluation operation. However, alternatively, while the refrigerant is circulated through the utilization-side units (60, 70), the refrigerant amount evaluation operation may be performed.

In the foregoing embodiment, the "discharge pressure of the compression element (20) (high-stage compressor (23))" is used as the "high-pressure-side pressure (high-pressure-side pressure of the refrigerant circuit (6) in the refrigeration apparatus (1))." However, alternatively, the "condensation pressure of the heat-source-side heat exchanger (24)," the "temperature-equivalent saturation pressure of the heat-source-side heat exchanger (24)," the "pressure of a portion of the liquid pipe (an upstream portion of the first pipe (40*a*)) from the heat-source-side heat exchanger (24) to the expansion valve (first outdoor expansion valve) (26)," or any other pressure may be used as the "high-pressure-side pressure."

In the foregoing embodiment, the heat-source-side unit (10) has the configuration illustrated in FIG. 1. However, the configuration of the heat-source-side unit (10) is not particularly limited as long as the heat-source-side unit (10) includes a compression element configured to compress the refrigerant, a heat-source-side heat exchanger, an expansion valve provided downstream of the heat-source-side heat exchanger, a receiver provided downstream of the expansion valve, and a control unit. Instead of a two-stage compression configuration of the foregoing embodiment including the low-stage compressors (21, 22) and the high-stage compressor (23), a single-stage or three-or-more-stage compression configuration, for example, may be used for the compression element (20).

While the embodiments have been described above, it will be understood that various changes in form and details can be made without departing from the spirit and scope of the claims. The foregoing embodiments may be appropriately combined or replaced. The expressions of "first," "second," . . . described above are used to distinguish the terms to which these expressions are given, and do not limit the number and order of the terms.

INDUSTRIAL APPLICABILITY

As can be seen from the foregoing description, the present disclosure is useful for a refrigeration apparatus and a method for determining the amount of a refrigerant in the refrigeration apparatus.

EXPLANATION OF REFERENCES

1 Refrigeration Apparatus
3 Gas Refrigerant Pipe (First Gas Connection Pipe)
10 Heat-Source-Side Unit
20 Compression Element
21 Low-Stage Compressor (First Compressor)
22 Low-Stage Compressor (Second Compressor)
23 High-Stage Compressor (Third Compressor)
23*a* Suction Pipe (Third Suction Pipe)
24 Heat-Source-Side Heat Exchanger (Outdoor Heat Exchanger)
25 Receiver
26 Expansion Valve (First Outdoor Expansion Valve)
41 Venting Pipe (Joint Pipe)
42 Venting Valve
60 Utilization-Side Unit (Air-Conditioning Unit)
70 Utilization-Side Unit (Refrigeration-Facility Unit)
101 Control Unit (Outdoor Controller)

The invention claimed is:

1. A refrigeration apparatus (1) comprising:

a heat-source-side unit (10) using a refrigerant that works in a supercritical region, the heat-source-side unit (10) including a compression element (20) configured to compress the refrigerant, a heat-source-side heat exchanger (24), an expansion valve (26) provided downstream of the heat-source-side heat exchanger (24), a receiver (25) provided downstream of the expansion valve (26), and a control unit (101), wherein the control unit (101) performs a first operation for evaluating an amount of the refrigerant based on a high-pressure-side pressure, on a first condition that an internal pressure of the receiver (25) be equal to or less than a supercritical pressure.

2. The refrigeration apparatus of claim 1, wherein
the first condition is a condition that the internal pressure of the receiver (25) be within a first pressure range in which pressures are equal to or less than the supercritical pressure.

3. The refrigeration apparatus of claim 2, wherein
the heat-source-side unit (10) further includes a venting pipe (41) through which a gas refrigerant is to be released from the receiver (25), and a venting valve (42) provided in the venting pipe (41), and
the control unit (101) adjusts an opening degree of the venting valve (42) such that the internal pressure of the receiver (25) is within the first pressure range in the first operation.

4. The refrigeration apparatus of claim 3, wherein
in the first operation, if the high-pressure-side pressure is less than a first predetermined value, the control unit (101) determines that the amount of the refrigerant is insufficient, and if the high-pressure-side pressure is greater than or equal to a second predetermined value, the control unit (101) determines that the amount of the refrigerant is excessive.

5. The refrigeration apparatus of claim 2, wherein
the heat-source-side unit (10) is connected to a utilization-side unit (60, 70),
the compression element (20) includes a low-stage compressor (21, 22) and a high-stage compressor (23) configured to compress the refrigerant compressed by the low-stage compressor (21, 22),
the heat-source-side unit (10) further includes a venting pipe (41) through which a gas refrigerant in the receiver (25) is introduced into a suction pipe (23*a*) of the high-stage compressor (23), and
in the first operation, the control unit (101) pauses the low-stage compressor (21, 22) and operates the high-stage compressor (23) to circulate the refrigerant through the high-stage compressor (23), the heat-source-side heat exchanger (24), the expansion valve (26), the receiver (25), the venting pipe (41), and the high-stage compressor (23) in this order.

6. The refrigeration apparatus of claim 2, wherein
in the first operation, if the high-pressure-side pressure is less than a first predetermined value, the control unit (101) determines that the amount of the refrigerant is insufficient, and if the high-pressure-side pressure is greater than or equal to a second predetermined value, the control unit (101) determines that the amount of the refrigerant is excessive.

7. The refrigeration apparatus of claim 1, wherein
the heat-source-side unit (10) is connected to a utilization-side unit (60, 70),
the compression element (20) includes a low-stage compressor (21, 22) and a high-stage compressor (23) configured to compress the refrigerant compressed by the low-stage compressor (21, 22),
the heat-source-side unit (10) further includes a venting pipe (41) through which a gas refrigerant in the receiver (25) is introduced into a suction pipe (23*a*) of the high-stage compressor (23), and
in the first operation, the control unit (101) pauses the low-stage compressor (21, 22) and operates the high-stage compressor (23) to circulate the refrigerant through the high-stage compressor (23), the heat-source-side heat exchanger (24), the expansion valve (26), the receiver (25), the venting pipe (41), and the high-stage compressor (23) in this order.

8. The refrigeration apparatus of claim 4, wherein
in the first operation, if the high-pressure-side pressure is less than a first predetermined value, the control unit (101) determines that the amount of the refrigerant is insufficient, and if the high-pressure-side pressure is greater than or equal to a second predetermined value, the control unit (101) determines that the amount of the refrigerant is excessive.

9. The refrigeration apparatus of claim 1, wherein
in the first operation, if the high-pressure-side pressure is less than a first predetermined value, the control unit (101) determines that the amount of the refrigerant is insufficient, and if the high-pressure-side pressure is greater than or equal to a second predetermined value, the control unit (101) determines that the amount of the refrigerant is excessive.

10. The refrigeration apparatus of claim 9, wherein
the control unit (101) determines the first and second predetermined values based on an outdoor air temperature.

11. The refrigeration apparatus of claim 10, wherein
the heat-source-side unit (10) is connected to a utilization-side unit (60, 70), and
in the first operation, if the high-pressure-side pressure is greater than a protection pressure value, and the outdoor air temperature is higher than or equal to a protection temperature, the control unit (101) releases an excess of the refrigerant to a gas refrigerant pipe (3) corresponding to the utilization-side unit (60) for a predetermined time, and then evaluates the amount of the refrigerant.

12. The refrigeration apparatus of claim 10, wherein
the compression element (20) includes a low-stage compressor (21, 22) and a high-stage compressor (23) configured to compress the refrigerant compressed by the low-stage compressor (21, 22), and
in the first operation, if the high-pressure-side pressure is greater than a protection pressure value, and the outdoor air temperature is higher than or equal to a protection temperature, the control unit (101) lowers a target value of a suction pressure of the high-stage compressor (23), and then evaluates the amount of the refrigerant.

13. The refrigeration apparatus of claim 1, wherein
while the high-pressure-side pressure is greater than or equal to the supercritical pressure, the control unit (101) performs the first operation, and while the high-pressure-side pressure is less than the supercritical pressure, the control unit (101) performs a second operation for evaluating the amount of the refrigerant on a second condition that the internal pressure of the receiver (25) be substantially equal to the high-pressure-side pressure.

14. The refrigeration apparatus of claim 13, wherein
the control unit (101) adjusts an opening degree of the expansion valve (26) to satisfy the second condition.

15. The refrigeration apparatus of claim 13, wherein
in the second operation, if the high-pressure-side pressure is less than a third predetermined value, the control unit (101) determines that the amount of the refrigerant is insufficient, and if the high-pressure-side pressure is greater than or equal to a fourth predetermined value, the control unit (101) determines that the amount of the refrigerant is excessive.

16. The refrigeration apparatus of claim 15, wherein
the control unit (101) adjusts an opening degree of the expansion valve (26) to satisfy the second condition.

17. The refrigeration apparatus of claim 1, wherein the refrigerant is carbon dioxide.

18. A method for evaluating an amount of a refrigerant in a refrigeration apparatus (1) including a heat-source-side unit (10) using the refrigerant that works in a supercritical region, the heat-source-side unit (10) including a compression element (20) configured to compress the refrigerant, a heat-source-side heat exchanger (24), an expansion valve (26) provided downstream of the heat-source-side heat exchanger (24), and a receiver (25) provided downstream of the expansion valve (26), the method comprising:

evaluating the amount of the refrigerant based on a high-pressure-side pressure on a first condition that an internal pressure of the receiver (25) be equal to or less than a supercritical pressure.

* * * * *